US010895031B2

(12) United States Patent
Thies et al.

(10) Patent No.: US 10,895,031 B2
(45) Date of Patent: Jan. 19, 2021

(54) METHOD FOR THE TREATMENT OF A TEXTILE SUBSTRATE, AND DEVICES FOR CARRYING OUT SAID METHOD

(71) Applicant: THIES GMBH & CO. KG, Coesfeld (DE)

(72) Inventors: Alexander Thies, Coesfeld (DE); Berthold Timmer, Coesfeld (DE)

(73) Assignee: THIES GMBH & CO. KG, Coesfeld (DE)

( * ) Notice: Subject to any disclaimer, the term of this patent is extended or adjusted under 35 U.S.C. 154(b) by 200 days.

(21) Appl. No.: 15/572,012

(22) PCT Filed: May 6, 2016

(86) PCT No.: PCT/DE2016/000192
§ 371 (c)(1),
(2) Date: Nov. 6, 2017

(87) PCT Pub. No.: WO2016/180390
PCT Pub. Date: Nov. 17, 2016

(65) Prior Publication Data

US 2018/0119323 A1 May 3, 2018

(30) Foreign Application Priority Data

May 8, 2015 (DE) ..... 10 2015 005 773

(51) Int. Cl.

| | |
|---|---|
| ***D06B 21/00*** | (2006.01) |
| ***D06B 1/02*** | (2006.01) |
| ***D06B 3/28*** | (2006.01) |
| ***D06B 3/32*** | (2006.01) |
| ***D06B 5/22*** | (2006.01) |
| ***D06B 5/26*** | (2006.01) |
| ***D06B 15/02*** | (2006.01) |
| ***D06B 15/04*** | (2006.01) |
| ***F26B 13/30*** | (2006.01) |
| ***D06P 1/00*** | (2006.01) |

(52) U.S. Cl.
CPC ..... *D06B 21/00* (2013.01); *D06B 1/02* (2013.01); *D06B 3/28* (2013.01); *D06B 3/32* (2013.01); *D06B 5/22* (2013.01); *D06B 5/26* (2013.01); *D06B 15/02* (2013.01); *D06B 15/04* (2013.01); *D06P 1/0016* (2013.01); *F26B 13/30* (2013.01); *D06B 2700/19* (2013.01); *D06B 2700/27* (2013.01); *D06B 2700/35* (2013.01)

(58) Field of Classification Search
CPC . D06B 21/00; D06B 1/02; D06B 3/28; D06B 3/32; D06B 5/22; D06B 5/26; D06B 15/02; D06B 15/04; F26B 13/30; D06P 1/0016
See application file for complete search history.

(56) References Cited

U.S. PATENT DOCUMENTS

| | | | | | |
|---|---|---|---|---|---|
| 3,921,420 | A | | 11/1975 | Aurich et al. | |
| 4,023,385 | A | * | 5/1977 | Hurd | D06B 3/28 68/62 |
| 4,716,744 | A | * | 1/1988 | Turner | D06B 3/28 239/434.5 |
| 4,829,620 | A | * | 5/1989 | Christ | D06B 3/28 68/178 |
| 4,885,814 | A | * | 12/1989 | von der Eltz | D06B 3/28 8/149.1 |
| 5,159,824 | A | * | 11/1992 | Stewart, Jr. | D06B 11/0059 68/205 R |
| 5,484,453 | A | * | 1/1996 | Baehr | D06L 1/14 8/111 |
| 2016/0076211 | A1 | | 3/2016 | Scuero | |

FOREIGN PATENT DOCUMENTS

| | | | | | |
|---|---|---|---|---|---|
| CN | 1306097 | | * | 5/2005 | D06B 3/28 |
| CN | 1616736 | A | | 5/2005 | |
| CN | 101591845 | A | | 12/2009 | |
| CO | 15238768 | | | 10/2015 | |
| DE | 8132854 | | | 11/1981 | |
| DE | 3323506 | A1 | | 1/1985 | |
| DE | 19924180 | A1 | | 11/2000 | |
| DE | 102012007802 | A1 | | 7/2013 | |
| DE | 102015012544 | A1 | | 4/2016 | |
| EP | 0640710 | A2 | | 8/1994 | |
| EP | 0652411 | A1 | | 10/1994 | |
| EP | 1024220 | A2 | | 1/2000 | |
| EP | 1024220 | | * | 8/2000 | D06B 3/28 |
| EP | 1367349 | A1 | | 5/2003 | |
| EP | 1835061 | A1 | | 9/2007 | |
| GB | 1389198 | A | | 4/1975 | |
| JP | 2000273754 | A | | 10/2000 | |
| RU | 2200214 | C1 | | 3/2003 | |
| SU | 1727536 | A3 | | 4/1992 | |
| WO | 2008058689 | A1 | | 5/2008 | |

* cited by examiner

*Primary Examiner* — Amina S Khan
(74) *Attorney, Agent, or Firm* — Hudak, Shunk & Farine Co. LPA

(57) ABSTRACT

A method for the treatment of a textile substrate is described, in which the substrate is arranged in a treatment device and treated with an aqueous treatment bath. Here the moisture of the textile substrate is adjusted to a predetermined moisture in the beginning of the treatment, whereby the treatment bath volume to be sprayed on the respective subject and per time unit is determined exactly, so that the textile subject provides the defined predetermined moisture at the end of the treatment. The therefore used devices enables the realization of the method for textile substrates designed as a fabric strand, a wide fabric web package and a fabric package.

22 Claims, 11 Drawing Sheets

METHOD FOR THE TREATMENT OF A TEXTILE SUBSTRATE, AND DEVICES FOR CARRYING OUT SAID METHOD

FIELD OF THE INVENTION

The present invention relates to a method for the treatment of a textile substrate at which the textile substrate is arranged in a treatment device and there treated with an aqueous treatment bath, that contains chemicals and treatment agents needed for the respective treatment in a concentration chosen for the respective treatment, as well as three devices for realization of the method, wherein in one embodiment the device includes a treatment device for arranging the textile substrate to be treated in the form of an endless fabric strand, an application nozzle for spraying the treatment agent, a reel for supporting the transport of the endless fabric strand, which is continuously transported in the treatment device, a transport nozzle impinged with gas, especially with air, for the endless fabric strand during the treatment and an outlet allocated at the bottom of the treatment device, for the treatment bath, that is not absorbed by the textile substrate, and a further device comprising a treatment device for taking up the textile substrate to be treated which is designed as a fabric web with a predetermined length, and two driven cylindric rolls, whereby the drive of the rolls is designed such, that the fabric web is transported reversibly from the one roll to the other roll and vice versa during the treatment and that it is guided and kept in a wide state via return pulleys, and that the treatment device provides an outlet at its bottom for the treatment bath, that is not absorbed by the textile substrate, and yet a further device that provides a horizontal centrifuge shaft in the treatment device for mounting the textile fabric to be treated during the treatment as a thread package or a fabric web package, whereby the centrifuge shaft provides a horizontal central bore equipped with at least one bath outlet opening, whereby furthermore the centrifuge shaft has a rotational drive at its one end and a bearing block as well as an end-sided supply of treatment bath at its other side, whereby the rotational drive and the bearing block are arranged outside the treatment device and the treatment device is provided with an outlet.

BACKGROUND OF THE INVENTION

Methods for textile treatment, for example pre-treatment methods, dyeing methods or post-treatment methods, are known in multiple forms and can be conducted continuously or discontinuously in the course of textile finishing of textile substrates. This especially includes processes of washing, boiling of, kier sourcing and bleaching, which are applied in the course of pre-treatment of the textile substrate, dyeing processes, which are applied in the course of coloration and includes a post-washing of the dyed textile substrate and finishing processes, with which the particularly pretreated and/or dyed textile substrate by contacting the treatment bath containing a finishing agent like a softening agent, a lubricant or an antistatic agent. The thereby known applied methods and thereby used devices are characterized by the fact that they often require high bath ratios (weight of the treated product: volume of the treatment bath), whereby the bath ratios (liquor ratios) vary between 1:0, 8 and 1:20, depending on the respective treatment method.

Thus, the EP 1 024 220 A1, filed by the applicant of the present application, describes a treatment method for a textile substrate, in which the textile substrate is wetted as an endless fabric strand with a treatment bath and the treatment bath is squeezed off the fabric strand immediately hereafter, whereby the squeezed treatment bath is collected separately from the fabric strand. To cause the necessary transport of the endless fabric strand, this fabric strand is impinged (treated) with a gas flow and put down in a reservoir for the fabric strand, and is wetted again with the treatment bath hereafter.

Although the known method and the therefore used device has been established and proven globally since their development about 18 years ago, in this known method the fabric strand to be treated is wetted with a surplus of treatment bath in the beginning of the treatment and hereafter is squeezed on a predetermined (default) residual liquor concentration, so that sufficiently large dimensioned ducts for the liquors are needed to supply the necessary volume of the treatment bath for wetting and to dissipate the squeezed treatment bath, whereby the temperature of the treatment bath varies between about 60° C. and about 140° C. depending on the respective treatment and the respective textile substrate.

SUMMARY OF THE INVENTION

The problem to be solved by the present invention is to provide a method in the stated way, which enables a further improved treatment of textile substrates compared to the known method and the known devices, and to provide the devices needed to conduct this treatment method.

This problem is solved inventively by a method for the treatment of a textile substrate at which the textile substrate is arranged in a treatment device and there treated with an aqueous treatment bath, that contains chemicals and treatment agents needed for the respective treatment in a concentration chosen for the respective treatment a) in the beginning of the treatment, the moisture of the textile substrate to be treated is adjusted to 40% to 180%, preferably between 60% and 160%, referred to the dry weight of the textile fabric to be treated, b) that the textile substrate is heated to a temperature needed for the respective treatment previously, simultaneously herewith or hereafter, c) that a treatment bath volume adjusted per time unit is determined by pumping the treatment bath via a bypass from at least one vessel for preparing the treatment bath through a pressure pump, a flowmeter and a control valve back into the at least one vessel for preparing the treatment bath, d) that hereafter the treatment bath volume of the respective treatment determined per time unit is linearly, progressively and/or degressively sprayed on the textile substrate for a predetermined treatment time, so that due to the spraying of the treatment bath volume during the treatment the moisture of the textile substrate is linearly, progressively and/or degressively increased thus far, that the treated textile substrate has final moisture values between 70% and 300%, preferably between 140% and 260% at the end of the treatment, relative to the dry weight of the textile substrate to be treated, e) that during the spraying of the treatment bath on the textile substrate the textile substrate is transported in the treatment device with an even speed as an endless fabric strand, or reversibly as a fabric reel in a width state, or, if the textile substrate is designed as a yarn package, the sprayed treatment bath is transported through the textile substrate or through the yarn package by rotation of the fabric reel or the yarn package, f) and that the treatment bath which is isolated and not absorbed during treatment is removed from the textile substrate, collected and sprayed again until the predetermined treatment time is elapsed or the treatment bath is sprayed on the textile substrate as far as possible, by a first device for realization the inventive method for a textile substrate designed as an endless fabric strand with the characteristic features of a) the transport nozzle is allocated behind the reel, viewed in the direction of the transport of the endless fabric strand to be treated, b) that the application nozzle for spraying the volume of the treatment bath, which is to spray each time unit onto the fabric strand, is located in the section of the reel, and c) that a bypass is attached to the application nozzle for reproducible adjusting of the treatment bath volume to be sprayed on per time unit, which includes a bypass calibration pipe, a pressure pump, a flowmeter, a first control valve, a second valve and at least one vessel for treatment liquor, a second device for realization the inventive method for a fabric reel with the characteristic features of a) in the treatment device at least one application nozzle is provided parallel to the width of the fabric web and in distance to it, b) that the at least one application nozzle is designed as a number of application nozzles, preferably identically designed application nozzles, adapted to the width of the fabric web, c) that a squeezing unit (Q1) is provided in between the rolls (W1, W2), and d) that a bypass is attached to the at least one application nozzle for adjusting the treatment bath volume sprayed per time unit, that includes a bypass calibration pipe, a pressure pump, a flowmeter, a first control valve, a second valve and at least one vessel for treatment liquor, which is designed in a wide state and is reversely transported, and a third device for realization the method for a textile substrate with the characteristic features of a) that the at least one bath outlet opening is arranged in the centrifuge shaft and designed as an application nozzle and preferably all bath outlet openings are designed as application nozzles, b) that for reproducible adjustment of the treatment bath volume applied per time unit a bypass is attached to the application nozzle as supply of treatment bath, that includes a bypass calibration pipe, a pressure pump, a flowmeter, a first control valve, a second valve and at least one vessel for the treatment liquor, and c) that an outlet is provided at the bottom side of the treatment device for the treatment bath which is not absorbed by the textile substrate, which is designed as a fabric reel.

The inventive method provides that the textile substrate is arranged in a treatment device for its treatment and there is treated with an aqueous treatment bath (treatment liquor), which contains the necessary chemicals and treatment agents needed for the respective treatment in the concentration chosen for the respective treatment. In the beginning of the treatment, the moisture off the textile substrate to be treated is adjusted to a value of 40% to 180%, especially between 60% to 160%, referred to the dry weight of the textile substrate to be treated. Previously, simultaneously herewith and/or hereafter the textile substrate is heated to the temperature needed for the respective treatment, without applying the actual treatment bath therefor. Rather the heating of the textile substrate happens depending on the respectively used device, the presentation of the textile substrate and the construction of the treatment device by perfusing of the textile substrate with accordingly heated air or steam, especially superheated steam, by heating of the walls of the treatment device and thus via radiant heat, via at least one heat exchanger arranged in the treatment device and or via at least one infrared radiation source, whereby the previously used term temperature means the initial temperature required for the respective treatment as well as the temperature during the treatment. In the next step, a treatment bath volume adjusted per unit of time is determined in the inventive method by carrying the treatment bath from at least one batching tank through a flowmeter and a control valve in the at least one batching tank again via bypass. As soon as the treatment bath volumes per unit of time is reliably determined and reproducibly adjusted for the respective treatment method, this treatment bath volume determined per time unit is sprayed linearly, progressively and/or degressively on the textile substrate for the predetermined treatment time, so that the linear, progressive and/or degressive spraying of this treatment bath volumes during treatment increases the moisture of the textile substrate to such an extent that the treated textile substrate shows a final moisture value between 70% and 300%, especially between 140% and 260%, referred to the dry weight of the treated textile substrate, in the end of the treatment.

During spraying of the treatment bath on the textile substrate, the textile substrate is transported as an endless fabric strand in the treatment device in an even speed, or reversely transported as an fabric reel in a wide state, or the sprayed treatment bath is transported through the textile substrate by rotation of the fabric reel, if the textile substrate is designed as a fabric reel. The treatment bath which is isolated and not absorbed, is separated from the textile substrate, intercepted and sprayed again until the designated treatment time is elapsed or the treatment bath is sprayed on the textile substrate to the greatest possible extent.

According to the preciously described transport of the textile substrate during the spraying of the treatment bath conducted in the inventive method it is noted, that the in a wide state reversely transported fabric reel means a transport of the fabric web, in which the fabric reel is wound upon a first roll in a wide state and hereafter during the spraying of the treatment bath volume determined per time unit is unwound from the first roll and wound upon a second roll, which is arranged parallel to the first roll. Thereby this winding and unwinding is repeated, until the inventive method is finished. The treatment bath volume determined per time unit is than conducted preferably in a site, where the fabric web is single-pass in a wide state between the both rolls.

The term "fabric reel" used in the present description includes the design of the textile substrate as a fabric, which is wound upon a girder (beam), or as a thread, which is wound upon a thread bobbin, whereby the textile substrate is treated in this design in a device that provides a horizontal centrifuge shaft in the treatment device for mounting the textile fabric to be treated during the treatment as a thread package or a fabric web package, whereby the centrifuge shaft provides a horizontal central bore equipped with at least one bath outlet opening, whereby furthermore the centrifuge shaft has a rotational drive at its one end and a bearing block as well as an end-sided supply of treatment bath at its other side, whereby the rotational drive and the bearing block are arranged outside the treatment device and the treatment device is provided with an outlet, wherein a) that the at least one bath outlet opening is arranged in the centrifuge shaft and designed as an application nozzle and preferably all bath outlet openings are designed as application nozzles, b) that for reproducible adjustment of the treatment bath volume applied per time unit a bypass is attached to the application nozzle as supply of treatment bath, that includes a bypass calibration pipe, a pressure pump, a flowmeter, a first control valve, a second valve and at least one vessel for the treatment liquor, and c) that an outlet is provided at the bottom side of the treatment device for the treatment bath which is not absorbed by the textile substrate. The device has a collection vessel for the treatment bath with a level regulation attached to the outlet allocated at the bottom of the treatment device, so that the there collected treatment bath is returned to the vessel for treatment liquor again through a feedback pipe, which is equipped with a pump in case of exceeding a predetermined level. The device has a vessel for preparing the treatment bath, which supplies the treatment bath into the vessel for treatment liquor through a pipe equipped with a further pressure pump and a dispensing valve, preferably in a volume adjustable per time unit. The device includes a bypass calibration pipe attached to a further pipe, that extends between the bypass calibration pipe and the application nozzle and is equipped with a third nozzle, whereby the pressure pump continuously supplies the treatment bath volume determined per time unit via the bypass calibration pipe if the first control valve and the third valve are opened as well as the second valve is closed.

During the spraying of the treatment liquor, the treatment temperature can be kept constantly at an adjusted temperature value or can be changed according to a predetermined temperature profile if desired or needed, whereby in the case of an increase of the temperature this is assigned via the previously preferably turned out heating elements and not or just to a lesser extent via the sprayed treatment bath and in the case of a decrease of the temperature there are appropriate heat exchanger assigned to the treatment device.

Surprisingly it was determined that one or more water layers developed on the surface of the textile substrate and/or in the textile substrate due to the adjustment of the moisture in the beginning of the treatment in the inventive method, so that the treatment agent, which is contained in the treatment bath adjusted per time unit, is spread significantly more even and faster over the surface of the textile substrate and thus causing an especially even treatment of the textile substrate with the respective treatment agent according to the inventors. This can be obviously monitored especially when the respective treatment bath contains a colored substance as treatment agent, like especially a water soluble dye, as hereby it can be observed, that already in the beginning of the treatment and beyond the whole period of time an even and thus equal dyeing of the treated textile substrate resulted, which is maintained even after termination of the inventive method.

Beyond that, the inventive method shows more advantages.

Due to the fact, that in the inventive method a relatively low treatment bath volume per time unit is sprayed on the textile substrate and that the textile substrate is not or just to a lesser extent heated via the treatment bath but via other heating sources as it is previously described, the inventive method shows a further improved economic efficiency compared to the prior art cited in the beginning. The low treatment bath volumes can be conveyed in accordingly small dimensioned pipes, so that the heating of this low treatment bath volumes required a significant lower energy requirement. Due to the low dead volume, there is less residual liquor volume as waste accrues in the end of the treatment in the inventive method, so that in consideration of environmental aspects the inventive method enables an improved environmental compatibility of the treatment of textile substrates with a treatment bath regarding the waste aspect as well as the energy aspect compared to the previously described known methods. Due to the low water consumption, significant less residues of the treatment agents and also less chemicals used for realization the method get into the waste in the inventive method. Furthermore it was determined, that the textile substrates treated accordingly to the inventive method caused a higher dye stuff yield during dyeing, that also foam free dyeing can be conducted hereby and overall faster total process times resulted, so that the inventive devices that are used for realization the inventive method and described hereinafter accordingly show a lower electricity consumption compared to common devices and thus the productivity and availability of the device increases due to the shortened treatment times.

For clarification it is noted, that the term treatment bath (respectively liquor) described a bath, that contains the actual treatment agent or the actual treatment agents for achieving the treatment purpose. In addition to those actual treatment agents, that include especially tensides, bleaching agents, dyes, softening agent, antistatic agents, lubricants, water repellents and/or hydrophylising agents, chemicals, such as wetting agents, dyeing carrier, levelling agents, dispersing agents, emulsifiers can be contained in the treatment bath, whereby these chemicals are termed occasionally as textile chemicals and support the efficiency of the treatment agents and/or their application on the textile substrate.

Furthermore, it is noted, that the term "and/or" used in the present description includes the so connected single elements of a recital additively as well as alternatively, so that these elements are understands as optionally connected with "and" respectively "or". Also, the terms used in singular obviously includes the plural and the terms used in plural obviously includes the singular.

The here used term "water" includes the water which is usually designated as hard water and softened water in the textile finishing, as well as aqueous salt solutions and aqueous systems, which are accordingly acidified or alkalinized for adjusting the desired pH-value.

Depending on the respective design of the textile substrate to be treated and on the device used for realization the inventive method, there are several possibilities for adjusting the moisture of the textile substrate to be treated in the beginning of the inventive method.

An embodiment of the previously described inventive method, in which the textile substrate is designed as an endless fabric strand or as an reversely transported fabric reel suggests, that the moisture of the textile substrate to be treated is adjusted in the beginning of the treatment by spraying a defined water volume on the textile substrate during its transport and by transporting the endless fabric strand or the fabric reel in the treatment device for a predetermined time, until the textile substrate provides the moisture required in the beginning of the treatment of between 40% and 180%, especially between 60% and 160%, referred to the dry weight of the textile substrate to be treated.

As an alternative hereto, a version of the previously describe method provides that the textile substrate is designed as an endless fabric strand or as an reversely transported fabric reel, too, and that the textile substrate is wetted with water, especially with heated water and/or saturated steam in the beginning of the treatment, and that hereafter a dehydration of the wetted textile substrate is conducted to the moisture, that is adjusted in the beginning of the treatment to 40% to 180, preferably between 60% and 160%, referring to the dry weight of the textile fabric to be treated.

If, however, the textile substrate to be treated by the inventive method is designed as a fabric reel, the moisture of the textile substrate to be treated is adjusted by spraying a defined water volume in the textile substrate and by rotating the fabric reel in an embodiment of the inventive method in the beginning of the treatment, until the textile substrate provides the moisture needed in the beginning of between 60% and 160%, referred to the dry weight of the textile subject to be treated.

Especially if the textile substrate shows a particular bad wetting ability, for example due to its particular dense construction, its high amount of hydrophobic fibers and/or due to adhesive lubricants or preparation, which are used during the fiber production, thread production or during the production of fabrics, the water sprayed on to adjust the moisture is added with at least one wetting agent, preferably a non or just slightly foaming wetting agent, in an embodiment of the inventive method.

If the textile substrate to be treated is firstly wetted with water and/or saturated steam and then by dehydration the moisture needed in the beginning of between 40% and 180%, especially between 60% and 160% is adjusted a further embodiment of the inventive method provides that here the dehydration of the textile substrate is implemented due to a blowing and/or a cross flowing with air, especially with heated air. This embodiment is used whenever the textile substrate is treated as an endless fabric strand or as a fabric reel according to the inventive method, as it is described in detail hereafter in conjunction with the first device includes a treatment device for arranging the textile substrate to be treated in the form of an endless fabric strand, an application nozzle for spraying the treatment agent, a reel for supporting the transport of the endless fabric strand, which is continuously transported in the treatment device, a transport nozzle impinged with gas, especially with air, for the endless fabric strand during the treatment and an outlet allocated at the bottom of the treatment device, for the treatment bath, that is not absorbed by the textile substrate, wherein a) the transport nozzle is allocated behind the reel, viewed in the direction of the transport of the endless fabric strand to be treated, b) that the application nozzle for spraying the volume of the treatment bath, which is to spray each time unit onto the fabric strand, is located in the section of the reel, and c) that a bypass is attached to the application nozzle for reproducible adjusting of the treatment bath volume to be sprayed on per time unit, which includes a bypass calibration pipe, a pressure pump, a flowmeter, a first control valve, a second valve and at least one vessel for treatment liquor. The device has a collection vessel for the treatment bath with a level regulation is attached to the outlet allocated at the bottom of the treatment device, so that the there collected treatment bath is by overrunning a predetermined level returned to the vessel for treatment liquor again through a feedback pipe, which is equipped with a pump in case of exceeding an adjustable level. A vessel for preparing the treatment bath is provided, that injects the treatment bath into the vessel for treatment liquor through a pipe equipped with a further pressure pump and a dispensing valve, preferably with a volume adjustable per time unit. The bypass calibration pipe that is connected by a pipe, which extends between the bypass calibration pipe and the application nozzle and is equipped with a third valve, whereby the pressure pump continuously supplies the treatment bath volume determined per time unit via the bypass calibration pipe if the first control valve and the third valve are opened as well as the second valve is closed. The device has an element attached to the bottom section of the treatment device, which separates during the treatment, the treatment bath not absorbed from the fabric strand. The device has an element that is designed as a fabric store, especially as a J-box, whereby the floor of the fabric store is provided with openings. The device that has a reel that is allocated in a case, which is attached to the treatment device and that the application nozzle for spraying of the treatment bath is allocated at the head side of the case. The device has a dehydration module and/or a further transport nozzle for the fabric strand driven by the treatment bath that is/are allocated in the treatment device. The dehydration module is allocated prior to the reel and/or the transport nozzle driven by treatment bath is allocated behind the reel, viewed in the transport direction of the fabric strand. The dehydration module provides a pipe-like duct for the endless fabric strand, which is connected through a pipe to a side channel blower, especially a frequency-controlled side channel blower, that the hereby compressed air, heated by a heat exchanger is supplied to the duct of the fabric strand, while the air having perfused the duct of the fabric strand is simultaneously removed from the duct of the fabric strand and lead through a fluff filter, a cooler and/or a water separator and returned to the side channel blower. The duct of the fabric strand of the dehydration module contains a cross section with an adjustable diameter. The duct of the fabric strand of the dehydration module provides a rectangular cross section, the rectangular cross section is formed by two interlinking U-shaped sections, whereby the first U-shaped section is provided with the pressure-sided joining of the side channel blower and the second U-shaped section is provided with the suction-sided join of the side channel blower, and the first U-shaped section is movable in the direction towards the second U-shaped section and in the opposite direction, or the second U-shaped section is movable in the direction of the first U-shaped section and in the opposite direction. The pipe-like duct of the fabric strand provides a U-shaped cross section, whereby the legs of this U-shaped section are interlinked by a first outwardly arched wall section thereby forming the outer pipe, and that a second section arched contrarily to the first wall section is allocated in the outer pipe, which is mounted movably in the direction of the first wall section and in the opposite direction. The pressure-sided joining of the side channel blower is provided with a nozzle allocated in the duct of the fabric strand and/or the the suction-sided joining of the side channel blower is provided with a suction chamber allocated in the duct of the fabric strand for the water aspirated from the fabric strand during the dehydration of the fabric strand. The second device for realization of the method comprises a treatment device for taking up the textile substrate to be treated which is designed as a fabric web with a predetermined length, and two driven cylindric rolls, whereby the drive of the rolls is designed such, that the fabric web is transported reversibly from the one roll to the other roll and vice versa during the treatment and that it is guided and kept in a wide state via return pulleys, and that the treatment device provides an outlet at its bottom for the treatment bath, that is not absorbed by the textile substrate, wherein a) in the treatment device at least one application nozzle is provided parallel to the width of the fabric web and in distance to it, b) that the at least one application nozzle is designed as a number of application nozzles, preferably identically designed application nozzles, adapted to the width of the fabric web, c) that a squeezing unit (Q1) is provided in between the rolls (W1, W2), and d) that a bypass is attached to the at least one application nozzle for adjusting the treatment bath volume sprayed per time unit, that includes a bypass calibration pipe, a pressure pump, a flowmeter, a first control valve, a second valve and at least one vessel for treatment liquor for the inventive method.

Regarding the temperature, with which the textile substrate is treated, it is noted, that this temperature depends on the kind of treatment and the kind of fiber the textile substrate is made of. If the textile substrate is only made of synthetic fibers and if such a textile substrate is for example shrunk, washed, dyed, finished and/or softened by the inventive treatment, the temperature in this treatment varies between 40° C. and 140° C., especially between 60° C. and 130° C.

However, if the textile substrate consists of natural fibers and is treated accordingly to the claimed method in a way it is described previously for textile substrate consisting of synthetic fibers, the treatment temperature varies between 40° C. and 110° C.

Overall it is noted that the inventive method as such regardless of the fiber substrate which the textile substrate consists of, can be implemented in a range of temperature especially between 40° C. and 140° C., regardless of the respective treatment and the kind of construction of the textile substrate, so that an accordingly versatile device is designed in such a way, that the treatment device, in which the respective treatment is implemented accordingly to the inventive method, is formed preferably as a pressure vessel.

Regardless of the construction the respective textile substrate to be treated shows, especially regardless of the fact if it is a woven or knitted fabric or a thread, the moisture of the textile substrate to be treated varies between 80% and 180% and preferably between 120% and 180% in the beginning of the treatment, each referred to the dry weight of the textile substrate to be treated. Hereby this moisture value applies preferably to such textile substrates, that solely consists of natural fibers or textile substrates, in which natural fibers predominate, meaning they are contained to at least 50% by weight and preferably to at least 70% per weight.

In previously described embodiment of the inventive method the moisture of the textile substrate is increased during the inventive treatment by spraying the treatment bath to a final moisture value between 180% and 300%, preferably between 180% and 250%, referred to the dry weight of the textile substrate to be treated.

Though the textile substrate to be treated solely consists of synthetic fibers or predominately consists of synthetic fibers, meaning to at least 50% per weight and preferably to at least 70% per weight, the moisture of the textile substrate to be treated is adjusted to 40% up to 120%, preferably to 60% up to 120% in the beginning of the treatment, each referred to the dry weight of the textile substrate to be treated, whereas the textile substrate provides a final moisture value between 90% and 250%, preferably between 110% and 220% at the end of the treatment, each refereed to the dry weight of the textile substrate to be treated.

Especially depending on the respective textile substrate to be treated in the respective design and thus depending on the device used for the respective treatment and the respective treatment, the treatment bath volume to be sprayed per time unit varies between 1 l/min and 12 l/min, especially between 2 l/min and 8 l/min.

The pressure with which the volume of the respective treatment bath dosed per time unit is sprayed linearly, progressively and/or degressively, varies between 1.5 bar and 6 bar, preferably between 2 bar and 4 bar in the inventive method. If the respective treatment of the textile substrate is implemented (carried out) in a treatment device and if the pressure in this treatment device is over the standard pressure and thus creating an overpressure in the treatment device, this overpressure is added up the previously mentioned pressure of the treatment bath to be sprayed on.

As it is mentioned before at the inventive method, especially the textile substrate is heated to the needed treatment temperature during the whole treatment by the tempered air which is discharged in the treatment device or by radiation heat or it is hereby adjusted to a predetermined temperature profile. This treatment is especially suitable for the treatment of an endless fabric strand, due to which the air used for temperature control of the textile substrate to be treated can simultaneously used for the transport of the fabric strand by the device which is used for it and described hereinafter.

As a treatment bath, especially a pre-treatment bath, a bleaching bath, alkalization bath, a desizing bath, an enzyme bat, a dyeing bath, a washing bath, a soaping bath, a post-treatment bath and/or a softening bath is chosen in the inventive method.

In the embodiment of the inventive method, in which the device for realization of the method provides a horizontal centrifuge shaft in the treatment device for mounting the textile fabric to be treated during the treatment as a thread package or a fabric web package, whereby the centrifuge shaft provides a horizontal central bore equipped with at least one bath outlet opening, whereby furthermore the centrifuge shaft has a rotational drive at its one end and a bearing block as well as an end-sided supply of treatment bath at its other side, whereby the rotational drive and the bearing block are arranged outside the treatment device and the treatment device is provided with an outlet, wherein a) that the at least one bath outlet opening is arranged in the centrifuge shaft and designed as an application nozzle and preferably all bath outlet openings are designed as application nozzles, b) that for reproducible adjustment of the treatment bath volume applied per time unit a bypass is attached to the application nozzle as supply of treatment bath, that includes a bypass calibration pipe, a pressure pump, a flowmeter, a first control valve, a second valve and at least one vessel for the treatment liquor, and c) that an outlet is provided at the bottom side of the treatment device for the treatment bath which is not absorbed by the textile substrate, wherein the collection vessel for the treatment bath with a level regulation is attached to the outlet allocated at the bottom of the treatment device, so that the there collected treatment bath is returned to the vessel for treatment liquor again through a feedback pipe, which is equipped with a pump in case of exceeding a predetermined level, wherein a vessel for preparing the treatment bath, which supplies the treatment bath into the vessel for treatment liquor through a pipe equipped with a further pressure pump and a dispensing valve, preferably in a volume adjustable per time unit, wherein the bypass calibration pipe attached to a further pipe, that extends between the bypass calibration pipe and the application nozzle and is equipped with a third nozzle, whereby the pressure pump continuously supplies the treatment bath volume determined per time unit via the bypass calibration pipe if the first control valve and the third valve are opened as well as the second valve is closed, and which is previously designed as third device, the fabric reel is driven in a rotation speed of 5 revolutions/min and 1,200 revolutions/min for adjusting the moisture in the beginning of the treatment between 40% and 180%, especially between 60% and 160%, referred to the dry weight of the textile substrate to be treated (characteristic feature a) of the main claim) and adjusting the moisture after spraying with the treatment bath volume determined per time unit to a final moisture value between 60% and 300%, especially between 70% and 120% in the end of the treatment, referred to the dry weight of the textile substrate to be treated.

Especially a substrate made of cotton or containing cotton is treated and dyed with a dyeing bath containing at least one reactive dye as textile substrate in the inventive method. If this textile substrate made of cotton or containing cotton is pre-treated and preferably post-treated (soaping) accordingly to the inventive method in this embodiment of the inventive method, the advantages mentioned previously in the inventive method, especially the saving of water and energy, can be realized to a particular large extent.

These advantages can be heightened by reducing the amount of salt which is necessary for common dyeing processes during the dyeing with at least one reactive dye, whereby the concentration of the reduced amount of salt varies between 0 g/l and 30 g/l dyeing bath, especially between 2 g/l and 30 g/l dyeing bath.

Furthermore the present invention relates to three devices for realization of the previously described inventive method.

The present invention relates to a first device for realization of the inventive method, whereby the first device includes a treatment device, especially a cylindrical vessel designed as a pressure vessel, for arranging the textile substrate to be treated in the form of an endless fabric strand, an application nozzle for spraying the treatment bath, a reel for supporting the transport of the endless fabric strand which is continuously transported in the treatment device, a transport nozzle for the endless fabric strand, which is impinged with gas, especially with air, and an outlet for the treatment bath, which is not absorbed by the textile substrate and which is arranged at the bottom of the treatment device. For this device, it is inventively recommended, that the transport nozzle is arranged behind the reel, viewed in the direction of transport of the endless fabric strand, that the application nozzle for spraying of the treatment bath volume applied on the fabric strand per time unit, is positioned in the section of reel and that a bypass is allocated to the application nozzle for reproducible adjusting of the treatment bath volume sprayed per time unit, which includes a bypass calibration pipe, a pressure pump, a flowmeter, a first control valve, a second valve and at least one vessel for treatment liquor.

Surprisingly it was found, that the first inventive device for realization of the inventive method enables a highly energy- and bath-saving treatment of the textile substrate designed as an endless fabric strand an simultaneously guarantees a reproducible and flawless treatment result, without the occurrence of inequality of the treatment effect, trop spots, different different shades of color while repeated dyeing or damages of good, like for example irreversible wrinkles generating during treatment, ruptures and/or abrade regions. The inventors of the previous device trace the positive effects back to the fact that in the previously described arrangement, that the reel is arranged in front of the transport nozzle and that the spraying of the treatment bath volume, which is applied on the fabric strand per time unit occurs by the application nozzle. Furthermore they trace it back to the fact that the treatment bath volume, which is sprayed per time unit, is initially adjusted to an exactly predetermined value in the beginning of the treatment by the bypass and is lead only hereafter to the application nozzle and sprayed linearly, progressively and/or degressively in a transport speed that is adjusted to the textile substrate to be respectively treated.

In an embodiment of the inventive first device, the outlet for the treatment bath which is arranged at the bottom of the treatment device includes a collection vessel for the treatment bath with a level regulation, whereby in case of exceeding of an adjustable level the relatively slight treatment bath accumulated there is returned to the vessel for treatment liquor through a return conduit which contains a pump. This collection vessel for the treatment bath guarantees that the treatment bath, which is not absorbed by the fabric strand after spraying the treatment bath volume adjusted per time unit, gets uncontrolledly in contact again with the fabric strand during the deposition of the fabric strand in the device, as this bath is caught at the bottom through the collection vessel for the treatment bath and is returned to the vessel for treatment liquor via a pump.

Another embodiment of the inventive device provides that a vessel for preparing the treatment bath is included additionally to the vessel for treatment liquor, which injects the treatment bath in the vessel for treatment liquor through a pressure pump and a pipe with a dispensing valve, preferably in a volume adjustable per time unit. This vessel for preparing the treatment baths enables the preparation of several treatment bathes in the vessel for preparing the treatment bath for such treatments, which are implemented by the inventive device and in which several treatment bathes with different treatment agents are sprayed after one another on the endless fabric strand which is continuously transported in the inventive device, so that a change of these treatment bathes is made possible.

In particular in this first inventive device the bypass calibration pipe is attached to pipe which is extended between the bypass calibration pipe and the application nozzle and is equipped with a third valve, whereby the pressure pump continuously transports the treatment bath volume determined per time unit to the application nozzle via bypass calibration pipe while the first control valve is opened and the third valve is opened, as well as while the second valve is closed.

As already described in connection with the inventive device and to prevent that after the spraying of the treatment bath the endless transported fabric strand does not uncontrolledly get in contact with the not absorbed and separated treatment bath during treatment in the inventive device, an embodiment of the inventive device provides that an element is allocated to the bottom sector of the treatment device, which is designed as a fabric store for the fabric strand and especially as a J-box, whereby the fabric store or the J-box is provided with opening gaps at the bottom, so that the treatment bath, which is not absorbed and separated during treatment cannot get in uncontrolled contact with the fabric strand transported by the inventive device again. Below this element the previously described small-volume collection vessel for the treatment bath with related level regulation is especially provided.

In the inventive device especially the reel is arranged in a case linked with the treatment device, whereby the application nozzle for spraying of the treatment bath is attached at the head end of that case. Thus this special arrangement enables that the treatment bath volume determined per time unit is sprayed particularly even on the fabric strand to be treated due to the application nozzle attached at the head end of the case during the transport of the endless fabric strand.

Another embodiment of the first inventive device provides that here a dehydration module and/or a further transport nozzle, which is run on treatment bath, for the endless fabric strand is or are arranged inside the treatment device.

Especially when the treatment device provides a further transport nozzle run on treatment bath for the fabric strand additionally to the transport nozzle run on air, a such designed device can not only be used for realization the inventive method but also like any common treatment device known in principle, as the endless fabric strand can be run continuously with the transport nozzle run on treatment bath during the treatment using a short liquor ratio known in principle. It is clearly noted, that this further transport nozzle for the fabric strand run on treatment bath is not used for realization the inventive method, as it is previously described, as the fabric transport needed for the inventive method is exclusively occurred by the transport nozzle impinged with a gas and especially with air. This additional transport nozzle run on treatment bath is arranged behind the reel viewed in the transport direction of respective fabric strand and can be used for dehydration of the endless fabric strand which is transported through the treatment device in the beginning of the treatment to a moisture value between 40% and 180%, especially between 60% and 160%, referred to the dry weight of the fabric strand to be treated respectively during the realization of the inventive method in this first device.

The dehydration module in this first inventive device is especially arranged in front of the reel viewed in the transport direction of the fabric strand and the transport nozzle run on treatment bath, which is optionally provided, is arranged behind the reel.

The dehydration module contained in the inventive device is preferably designed in the way that it provides a pipe-like designed duct for the fabric strand, which is attached to a side channel blower, specially a frequency-regulated side channel blower, whereby the air which is compressed due to this and heated by a heat exchanger, is supplied to the duct of the fabric strand, while simultaneously the air which perfuses through the duct of the fabric strand is removed from the duct of the fabric strand through a fluff filter, a cooler and/or a water separator and brought back to the side channel blower again. Especially the supply of the heated air and the removal of the air perfused through the duct of the fabric strand are arranged in opposite areas of the duct of the fabric strand.

According to the embodiment of the duct of the fabric strand there are various possibilities. A first possibility provides that the duct of the fabric strand of the dehydrating module is designed as a pipe which is extended in the conveying direction of the endless fabric strand. To eliminate the danger of a damage of the endless fabric strand to be dehydrated during its transport through the duct of the fabric strand, preferably the inner surfaces of the duct of the fabric strand are partially or completely lined with a synthetic material, especially with Teflon material.

Another embodiment of the duct of the fabric strand recommends that the pipe which is extended in the conveying direction of the endless fabric strand provides a square, circular or oval cross section. This kind of ducts of the fabric strand, designed accordingly to their cross section, are always provided when such fabric strands are dehydrated by the first inventive device, that do not involve increased precautions due to their width, their grammage and/or their sensitivity in relation to the formation of undesired abraded regions of the surface.

However if fabric webs should be dehydrated by the dehydration module, that are different according to their width, their density, their sensitivity related to damages of the surface and/or their grammage, a versatile customizable embodiment of the dehydration module provides, that the duct of the fabric strand of the dehydration module provides a cross section which is adjustable in the diameter. Depending on the fabric strand to be dehydrated respectively, the cross section of the duct of the fabric web can be modified and customized accordingly in this embodiment of the duct if the fabric web, which not only results in an optimized, damage-free transport of the fabric strand through the duct of the fabric strand, but also in an optimized dehydration of the fabric strand.

It is especially preferable, if the inventive device provides a dehydration module, whose duct of the fabric strand provides a modifiable cross section, so that the duct of the fabric strand can be modified accordingly to the fabric web to be treated respectively. This embodiment of the duct of the fabric strand especially provides a rectangular cross section consisting of two interlinked U-shaped sections. The first U-shaped section is attached to the suction-side join of the side channel blower and the second U-shaped section is attached to the suction-sided join of the side channel blower. At least one of those U-shaped sections is mounted movably for adjusting the cross section of the duct of the fabric strand, whereby preferably the second U-shaped section is movable in the direction towards the first U-shaped section and in the opposite direction, as it is clarified hereinafter by a concrete embodiment of the duct of the fabric strand in conjunction with the figures.

Another embodiment of the duct of the fabric strand of the dehydration module, which also includes a cross section adjustable in its diameter, recommends that the duct of the fabric strand is designed as a pipe. This pipe provides a U-shaped cross section, whereby the legs of the U-shaped cross section are interlinked head-sided through a first wall section which is arched outwardly, thereby forming the outer pipe. Inside this outer pipe, a second wall section is attached to the first wall section in the opposite direction, which is mounted movably in the direction towards the first wall section and in opposite direction of the first wall section, which is arched outwardly, so that the cross section of the duct of the fabric strand can be enlarged or reduced.

Especially if the at least one pressure-sided joining to the side channel blower is attached to the first wall section arched outwardly and if the at least one suction-sided join is attached to the second wall section in the previously described embodiment, which is described hereinafter as an embodiment in conjunction with the figures, a further optimized dehydration of the duct of the fabric strand can be caused by the fact, that the fabric strand fits closely to the second arched section during its transport through the dehydration module and thus the water to be removed is aspirated optimally through the suction-sided join to the side channel blower.

Another embodiment of the dehydration module, which is especially optimized accordingly to the dehydration, provides, that the pressure-side join of the side channel blower with the duct of the fabric strand is designed as a nozzle. The efficiency of the dehydration module is further improved by providing a suction chamber for the water aspirated during dehydration in the suction-side join of the side channel blower within the duct of the fabric strand.

The second inventive device for realization the previously described inventive method provides a treatment device for absorbing the textile substrate to be treated, which is designed as a fabric web with a predetermined length and two driven cylindric rolls, whereby the drive of the rolls is designed in a way, that the fabric web is transported reversely from the one roll to the other and vice versa and guided and kept in a wide state due to return pulleys. Furthermore the treatment device provides a bottom-sided an outlet for the treatment bath, that is not absorbed by the textile substrate. At least one application nozzle is provided inventively in the treatment device, that is arranged parallel to the width of the fabric web and in distance to it, whereby the at least one application nozzle is designed as a number of single application nozzles, preferably identically designed application nozzles, adapted to the width of the fabric web. In between the rolls a squeezing unit is provided, whereby a bypass for the reproducible adjustment of the treatment bath volume sprayed per time unit is attached to the at least one application nozzle in the second inventive device, which includes a bypass calibration pipe, a pressure pump, a flowmeter, a first control valve, a second valve and at least one vessel for treatment liquor.

Also in this second inventive device for realization the inventive method, it was surprisingly determined, that the second device enables a highly energy- and bath-saving treatment of the fabric web, that is transported reversely back and forth between the both rolls, whereby the treatment device is preferably designed as a closed treatment device and especially as an autoclave. The treatments implemented inventively by the second embodiment do not show any inequalities of the treatment, trop spots, different shades of color even during dyeing or damages of the fabric web whereby this positive effects are traced back by the inventors of the second device to the fact, that the treatment device provides at least one application nozzle, that is arranged parallel and with distance, especially with adjustable distance, to the width of the fabric web, and preferably provides the number of application nozzles that is adjusted to the width of the fabric, and to the fact, that the spraying of the treatment bath volume, which is applied to the fabric web per time unit, happens via the at least one application nozzle.

Further the positive effect is traced back to the fact, that the treatment bath volume to be sprayed per time unit is adjusted exactly to a predetermined value by the bypass in the beginning of the treatment and supplied to the at least one first application nozzle and continuously sprayed linearly, progressively and/or degressively in a speed adjusted to the textile substrate to be treated. Numerous dyeing processes, which were made especially with woven fabric webs using the inventive device, showed that the so dyed fabric webs are dyed equally and neither show color differences relative to the length and/or width of the fabric. Especially for very dense woven fabrics or relatively thick fabric webs, for example for fabrication of sails or other especially thickly designed tissues, for example terrycloth, tarpaulin or especially very dense technical textile webs, the squeezing unit attached between the rolls effects that a migration and an especially even distribution of the treatment bath is evenly distributed over the thickness of the fabric additionally to the treatment bath volume sprayed per time unit. Also, this squeezing unit enables an especially easy adjustment of the moisture of the fabric to 40% to 180%, preferably between 60% and 160%, referring to the dry weight of the textile fabric to be treated, whereby a water volume, that guarantees approximately the starting moisture is chosen therefore, and the exact adjustment of the moisture of the fabric for the respective inventive method happens via the squeezing unit. Thus, this squeezing unit is included not inevitably, but expediently in the second inventive device.

In an embodiment of this second inventive device, a vessel for treatment liquor with a level regulation is allocated at the bottom side of the treatment device, whereby the there collected treatment liquor is piped to the vessel for treatment liquor through the feedback pipe equipped with a pump in case of exceeding an adjustable level. This vessel for treatment liquor guarantees that after spraying the treatment bath volume adjusted exactly per time unit the treatment bath does not get in uncontrolled contact again with the fabric web during the transport of the fabric web in the device.

As well as the first device, the second inventive device also provides a vessel for preparing the treatment bath additionally to the vessel for treatment liquor, that injects the treatment bath in the vessel for treatment liquor through a pipe equipped with a pressure pump and a dispensing valve, preferably in a volume adjustable per time unit. For example, this vessel for treatment liquor enables the preparation of treatment baths in the vessel for preparing the treatment bath during treatments that are implemented in the inventive device and in which multiple treatment baths with different treatment agents are sprayed one after another on the fabric web continuously transported in the inventive device, so that this change of the treatment bath is allowed without any time interruption.

Especially in the second inventive device, the bypass calibration pipe is attached by a pipe, that is extended between the bypass calibration pipe and the application nozzle and that is provided with a third valve, whereby the pressure pump continuously supplies the treatment bath volume determined per time unit via bypass calibration pipe, if the first control valve and the third valve are open as well as the second valve is closed.

To guarantee a proper and reproducible adjustment of the treatment temperature in the second inventive device, an embodiment of the second inventive device provides that a heating element, preferably for the air or steam, injected in the treatment case, is attached to the treatment case or that a heat exchanger and/or an IR-radiator is attached.

The third inventive device for realization the previously described inventive method provides a treatment device that is equipped with a central, horizontal centrifuge shaft for mounting the textile to be treated during treatment. The textile substrate to be respectively treated is designed as a thread package or as a fabric web reeled up on a fabric beam (breast beam). The centrifuge shaft is equipped with at least one horizontal, central bore that is attached to at least one bath outlet opening. Furthermore the centrifuge shaft provides a rotational drive at its one end and a bearing bench at its other end, whereby the rotational drive and the bearing benches are arranged outside the treatment device and the treatment device is equipped with an outlet. A device with horizontal centrifuge shaft in the treatment device for mounting the textile fabric to be treated during the treatment as a thread package or a fabric web package, whereby the centrifuge shaft provides a horizontal central bore equipped with at least one bath outlet opening, whereby furthermore the centrifuge shaft has a rotational drive at its one end and a bearing block as well as an end-sided supply of treatment bath at its other side, whereby the rotational drive and the bearing block are arranged outside the treatment device and the treatment device is provided with an outlet, is known from DE 10 2015 012 544.3, which also stem from the applicant of the present application, so that the disclosure of DE 10 2015 012 544.3 is established as the content of this description to prevent repetition.

Inventively, in the previously described device the at least one bath outlet opening, that is provided in the centrifuge shaft besides the horizontal, central bore, is designed as an application nozzle. However preferably a number of bath outlet openings or all bath outlet openings are designed as application nozzles. For reproducible adjustment of the treatment bath volume applied per time unit, a bypass for the treatment bath is applied to the central bore, whereby the bypass includes a calibration pipe, a pressure pump, a flowmeter, a first control valve, a second valve and at least one vessel for treatment bath, whereby an outlet for the treatment bath, that is not absorbed by the textile substrate, is provided at the bottom of the treatment device.

As it is already described previously for the first inventive device and the second inventive device, this bypass enables the exact adjustment of the treatment bath volume sprayed per time unit, whereby an even distribution of the treatment bath across the thickness of the thread bobbin respectively the fabric reel is caused by rotation of the centrifuge shaft during treatment. Depending on the textile substrate to be treated respectively, especially on its density, its construction and also the kind of fiber substrate the textile substrate is made of, a rotational speed in a range of the rotational speed as it is described previously in the inventive method is chosen.

Also, this third inventive device analogously or identically provides all advantages as they are described for the inventive method and for the first and second inventive device, so that it is pointed to this to prevent repetition.

An embodiment of the previously described inventive device provides, that a collection vessel for the treatment bath with a level regulation is attached to the an outlet that is includes at the bottom of the treatment device, so that the there collected treatment bath is returned to the vessel for treatment liquor through a feedback pipe equipped with a pump in case of exceeding an adjustable level.

An advantageous embodiment of the third inventive device recommends, that an additional vessel for treatment bath is provided additionally to the vessel for treatment liquor, which injects the respective treatment bath in the vessel for treatment liquor through a pipe equipped with a pressure pump and a dispensing valve, preferably with a volume adjustable per time unit. This additional vessel for treatment bath enables that especially in case of treatments, that are implemented in the inventive third device and in which multiple treatment baths with different treatment agents are sprayed on the textile substrate treated in the third inventive device one after the other, this treatment baths can be prepared in the additional vessel for treatment bath, so that the change of the treatment baths is allowed without any time interruption.

Another advantageous embodiment of the third inventive device recommends, that the bypass calibration pipe is attached to a pipe, that is extended between the bypass calibration pipe and the central bore and is equipped with a third valve, whereby the pressure pump continuously injects the treatment bath volume determined per time unit to the central bore and thus to the application nozzle respectively the application nozzles via bypass calibration pipe, if the first control valve and the third valve are opened as well as the second valve is closed.

Especially in all previously described inventive device the application nozzle is designed as a flat nozzle, as tubular nozzle or as a conical nozzle.

Advantageous embodiments of the inventive method as well as the three inventive devices for realization the inventive method are stated in the sub claims and in the following detailed description for the inventive devices and the inventive method.

BRIEF DESCRIPTION OF THE DRAWINGS

The present invention is now described in detail and shown in FIGS. 1 to 11. Hereby.

DETAILED DESCRIPTION OF THE INVENTION

In the FIGS. 1 to 11, the same parts are provided with the same reference numbers.

Figure 1:
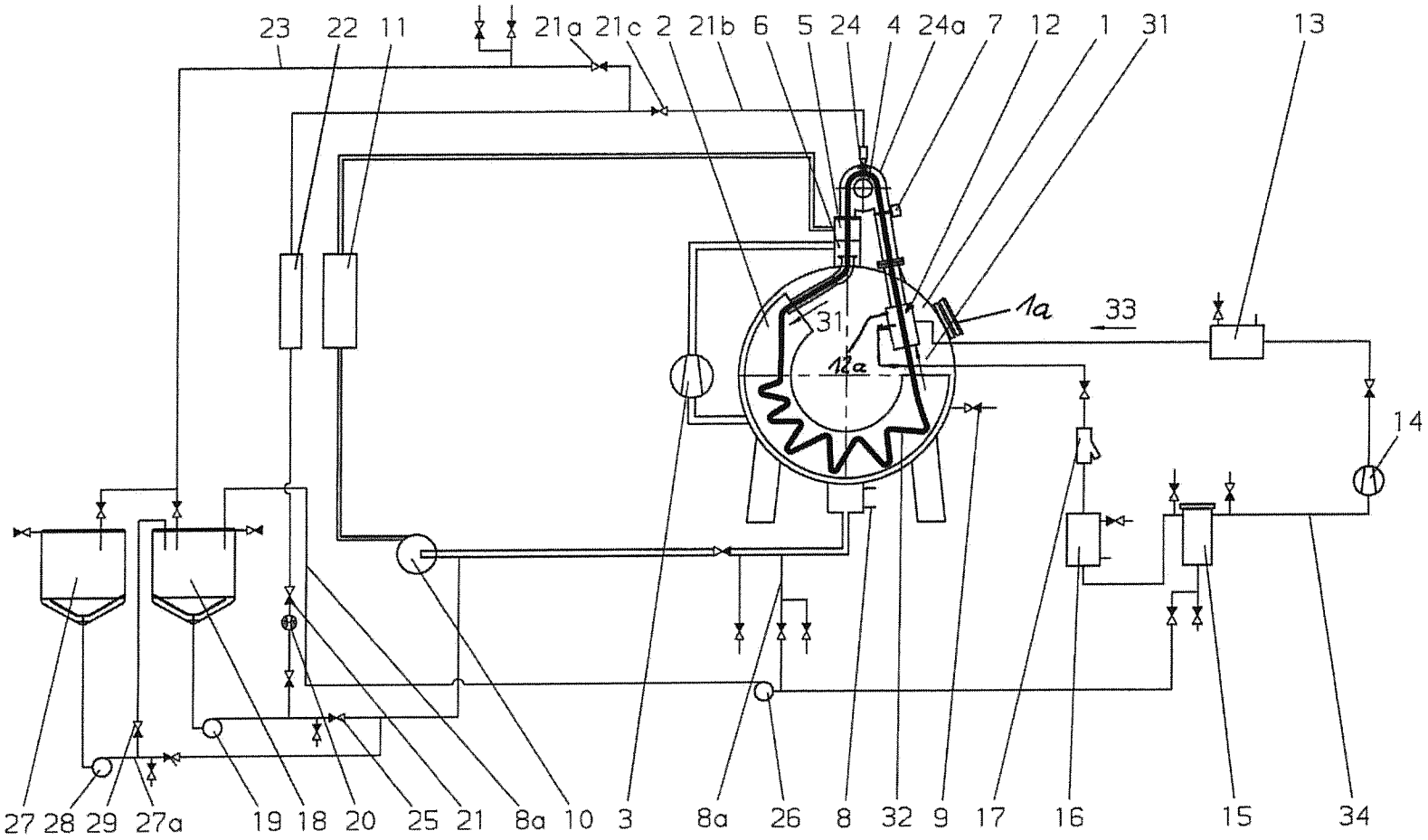
FIG. 1 is a first schematic figure of the first device for the treatment of an endless fabrics strand.

The device shown in FIG. 1, which is used for the treatment of an endless fabric strand with a treatment bath according to the previously described method and which is described as first device, provides a cylindric treatment device 1, which extends length wisely, whereby the front side and the back side of the treatment device 1 in arched, so that the treatment device 1 accordingly enables a treatment of a fabric strand 32 at treatment temperatures over 100° C. and thereby in case of overpressure.

The feeding of the treatment device 1 with the fabric strand 32 to be treated takes place by a feeding aperture 1*a*. Here the respective fabric strand 32 is drawn via a reel 4, which is allocated at the head side of the treatment device 1, and via an air-impinged transport nozzle 6 if necessary, until an endless fabric strand is produced through sewing of the start of the fabric web with its end. After closure of the feeding aperture 1*a*, the treatment device 1 is arranged for the respective treatment of the endless fabric strand 32, which is transported solely in the direction of the arrow via the reel 4 and the air-impinged transport nozzle 6 with the respectively chosen speed during the treatment with the respective treatment bath. An element 2 designed as a J-box is allocated behind the reel 4 and the air-impinged transport nozzle 6 viewed in the transport direction, whereby this element 2 guarantees, that the fabric strand is folded, put down and further transported in element 2 on the one hand, and that the treatment bath sprayed on the transported fabric strand to be treated via an application nozzle 24 does not get in contact again with the endless fabric strand on the other hand. To this, a duct of the fabric strand 12*a* of the dehydration module 12 in the direction of the transport of the endless fabric strand, whereby this dehydration module 12 is described hereinafter in detail in conjunction with the FIGS. 2 to 11.

The feeder of the air needed for the transport of the fabric strand to the transport nozzle 6 occurs by aspirating the air out of the treatment device 1 via a blower 3, especially a frequency-controlled blower, and by piping the air in the transport nozzle 6 through the appropriate pipe. Due to a heating element 9, which is assigned to the treatment device 1 and/or due to a not depicted heat exchanger, which is preferably allocated downstream of the blower 3, the air supplied to the transport nozzle 6 can be heated to a predetermined temperature, whereby the endlessly transported fabric strand 32 is heated accordingly by this air.

Only regarding the aspect of increasing the application possibilities of the device, but not of the here claimed method, a liquor cycle is assigned to the treatment device 1, which contains the bath pump 10, a heat exchanger 11 and a transport nozzle 5 run with liquor, whereby the pipe for the transport of the bath removes the treatment bath at the foot end of the treatment device and leads it to the transport nozzle 5 to be impinged with the bath through the bath pump 10 allocated in the pipe and through the heat exchanger 11.

To determine the treatment bath volume adjusted per time unit and to reproducibly spray it on the endless fabric strand, which is transported through the treatment device via the transport nozzle 6, via application nozzle 24, which is preferably a fan nozzle, a bypass is attached to the application nozzle 24, which is allocated at the head end of the case 24*a* of the reel 4, which includes a bypass calibration pipe 23, a pressure pump 19, a flowmeter 20, a first control valve 21, a second valve 21*a* and at least one vessel for treatment liquor 18.

Via the bypass calibration line 23, the respective treatment bath is transported through the pressure pump 19, the flowmeter 20, the first control valve 21, the heat exchanger 22 and through the opened second valve 21*a* and the bypass calibration pipe 23 as long as the treatment bath volume calibrated per time unit is supplied reproducibly to the vessel for treatment liquor 18. Only then a third valve 21*c*, through which the bypass calibration pipe 23 is attached to the application nozzle 24, is opened, while the second valve 21*a* is closed simultaneously with this, which leads to linear, progressive and/or degressive spraying of the treatment bath volume determined per time unit on the transported endless fabric strand through the pipe 21*b* of the application nozzle 24, until the predetermined treatment time is elapsed or the treatment bath is largely sprayed on the textile substrate. In this context, largely means that almost the whole bath is sprayed on the textile substrate despite a small dead volume of the pipe containing the treatment bath, whereby this pipe- and case-depending dead volume accounts for about 2% to 6%, referred to the total volume of the bath.

An outlet is arranged at the bottom of the treatment device 1, which contains a collection vessel for the treatment bath 18 equipped with a level regulation. In case of exceeding the configurable level, the there accumulated treatment bath is returned to the collection vessel for the treatment bath 18 through a feedback pipe 8*a*, which contains a pump 26. The previously described element 2 arranged in the treatment device 1 prevents that a small percentage of the fabric strand 32 possibly gets in undesired contact with the treatment bath previously sprayed via the application nozzle 24.

Furthermore, the device provides a vessel for preparing the treatment bath 27, which is attached to the vessel for treatment liquor 18 through a pipe 27*a* suchlike, that the treatment bath is injected from the vessel for preparing the treatment bath to the vessel for treatment liquor through the pipe 27*a*, which is equipped with a further pressure pump 28 and a dispensing valve 29, preferably with a volume configurated per time unit. Thus enables that the actual treatment bath can be split in two treatment baths, that contain different treatment agents, or that the actual treatment bath contains a number of treatment agents and thus is split into a first treatment bath proportion, which is allocated in the vessel for treatment liquor 18, and a second treatment bath proportion, whereby the second treatment bath proportion is allocated in the vessel for preparing the treatment bath 27, so that a controlled, time-delayed exposure of equal and different treatment agents is allowed due to time-delayed addition of the first treatment bath and the second treatment bath.

Due to a circulation control 7 it is guaranteed that the speed of the transported endless fabric strand is measured and that the fabric strand is transported at this speed, preferably at a constant speed, during the treatment.

Especially good treatment results are achieved with the first embodiment of the inventive device, if a heat exchanger (not depicted) is supplied in the flow direction of the air supplied to the transport nozzle 6, so that the fabric strand impinged with this air has an adjustable constant temperature.

The dehydration module overall referred to as 12, which is arranged in the treatment device, provides a pipe-like duct 12*a* for the fabric strand 32, which is attached to a side channel blower 14, especially with a frequency-controlled side channel blower through a pipe 34. The air which is compressed herewith and potentially heated additionally by a heat exchanger 13 is supplied to the duct of the fabric strand 12*a*, while the air which perfused the fabric strand 32 is removed from the duct of the fabric strand 12*a* through a fluff filter 17, a cooler 16 and/or a water separator 15 and is supplied to the side channel blower 14 again.

By means of the FIGS. 2 to 11 described hereinafter the dehydration module is described in detail.

The dehydration module overall referred to as 12 in FIG. 1 provides a pipe-like duct 12*a* for the endless fabric strand. This duct of the fabric strand 12*a* is attached to the pressure-side of a side channel blower 14 at the head end viewed in the transport direction, whereby the temperature is increased up to about 40° C. to about 95° C. due to the compression of the air in the side channel blower 14. This temperature of the compressed air transported in the direction of the arrow 33 can be increased further by a heat exchanger 13, if it is desired and necessary, so that heated air is supplied to the pipe-like designed duct of the fabric strand 12*a* at the pressure-sided joining, while the air that perfused the duct of the fabric strand 12*a* is removed at the bottom side through a fluff filter 17, a cooler 16 and/or a water separator 15 and supplied again to the side channel blower 14. According to the design of the dehydration module 12 and especially of the pipe-like designed duct of the fabric strand 12*a*, there are various possibilities as they are described in detail in FIGS. 2 to 11 hereinafter.

Figure 2:
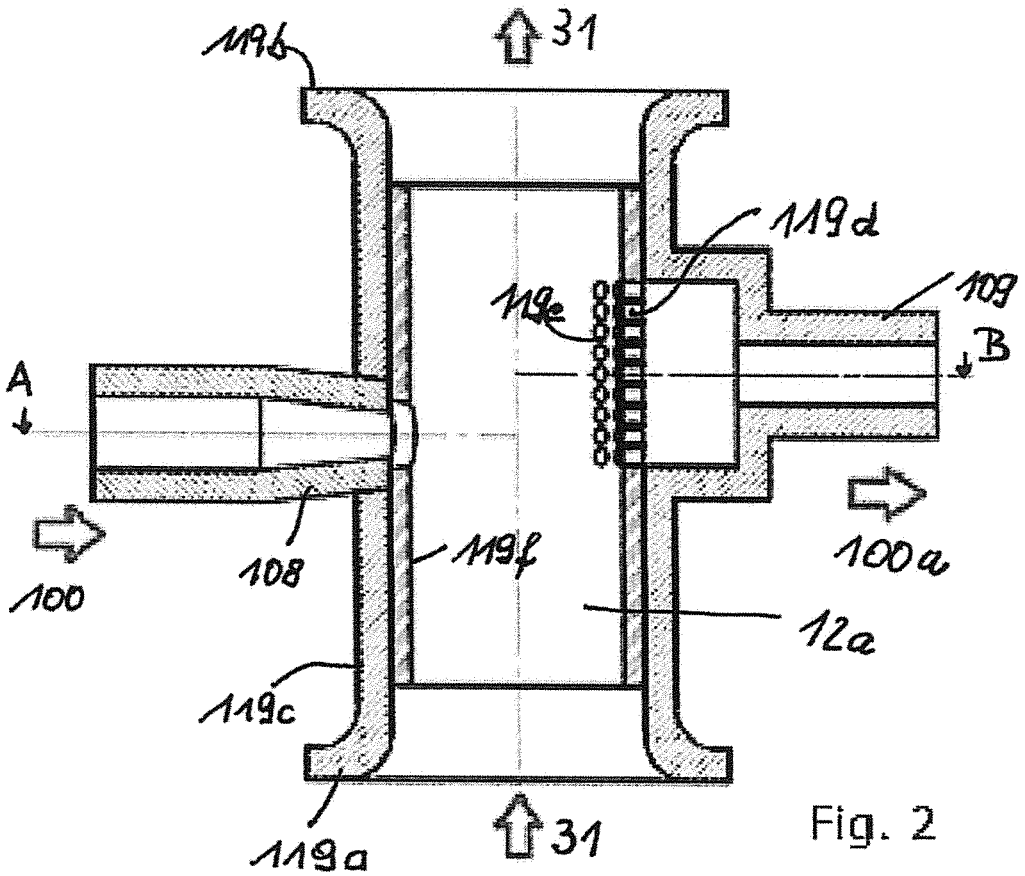
FIG. 2 is a schematic representation of a vertical section of a first embodiment of the duct of the fabric strand 12*a* of the dehydration module referred to as 12 in FIG. 1.
Figure 3:
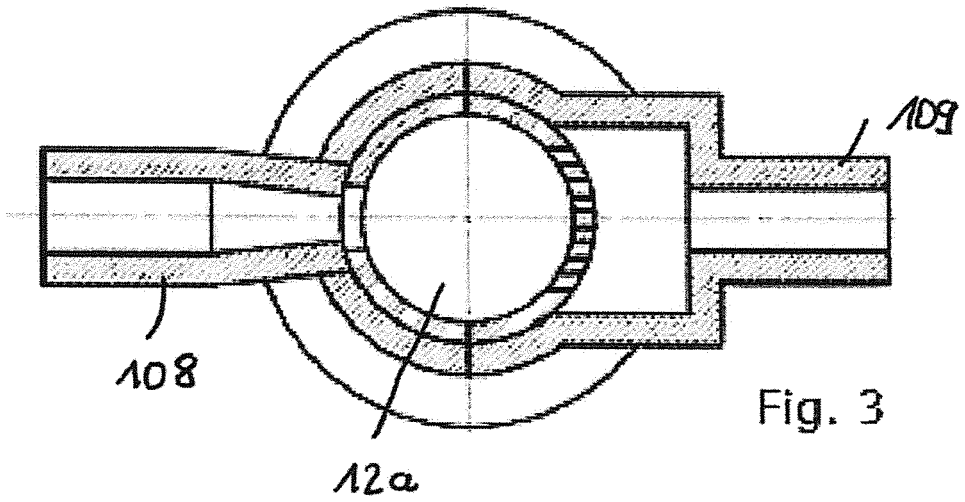
FIG. 3 is like FIG. 2, but as a horizontal section along the line A-B in FIG. 2.

The first embodiment of the duct of the fabric strand 12*a* of the dehydration module shown in the FIGS. 2 and 3 provides an upper pressure-sided joining and a bottom suction-sided joining 109 to the side channel blower 14, both formed as tubes. The compressed air is supplied through the pressure-sided joining 108 in the direction of the arrow 100, piped through the fabric strand 32 and removed through the suction-sided joining 109 in the direction of the arrow 100*a*. The endless fabric strand to be dehydrated (not depicted) is transported in the direction of the arrow 31 through the duct via the reel 4 and/or the transport nozzle 6 (FIG. 1) in a predetermined speed controlled by the circulation control 7 and is thus dehydrated evenly.

The duct of the fabric strand 12*a* provides respectively a funnel-shaped extension 119*a* and 119*b* respectively on the inlet side and on the outlet side, by what the injection of the fabric strand to be dehydrated 32 and the expel of the fabric strand are facilitated. Between those two funnel-shaped extensions a cylindric middle section 119*c* extends. At opposite sections of the cylindric middle section 119*c* the pressure-sided joining 108 and the suction-sided joining 109 are provided, whereby the air outlet of the pressure-sided joining 108 is designed as a nozzle and the air inlet of the suction-sided joining is designed as a perforated plate 119*d* with gliding bars 119*e* made of Teflon, which are arranged in front of it. Thus, it is prevented, that the endless fabric strand 32 which is transported through the duct of the fabric strand 12*a* during dehydration, is sucked in into suction-sided join 109, which could result in a damage of the fabric strand. Furthermore, an improvement of the careful transport of the fabric strand 32 through the duct is achieved by the fact that the cylindric section 119*c* of the duct of the fabric strand 12*a* is lined with Teflon 119*f* on the inside.

As it is seen in FIG. 2, the central axes of the pressure-sided joining 108 and of the suction-sided joining 109 are arranged shifted relative to one another, so that the central axis of the suction-sided joining 109 is arranged relatively higher than the central axis of the pressure-sided joining 108, viewed in the direction of the transport 31. Due to such an arrangement of the central axis it is achieved that the air entrained during the transport of the fabric strand can be removed faster and better from the duct of the fabric strand 12*a* at the suction-sided join 109. The cross section of the duct of the fabric strand 12*a* depicted in the FIGS. 2 and 3 is not modifiable.

Figure 4:
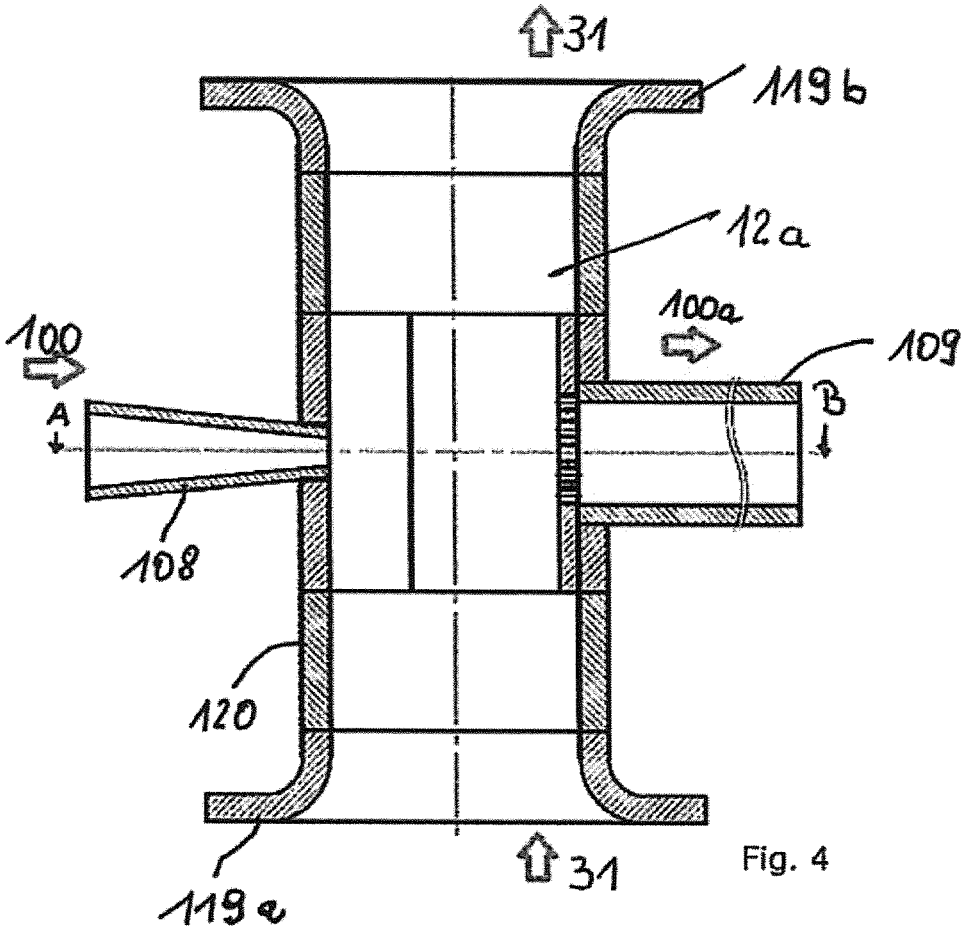
FIG. 4 is a schematic representation of a vertical section of a second embodiment of the duct of the fabric strand 12*a* of the dehydration module referred to as 12 in FIG. 1.
Figure 5:
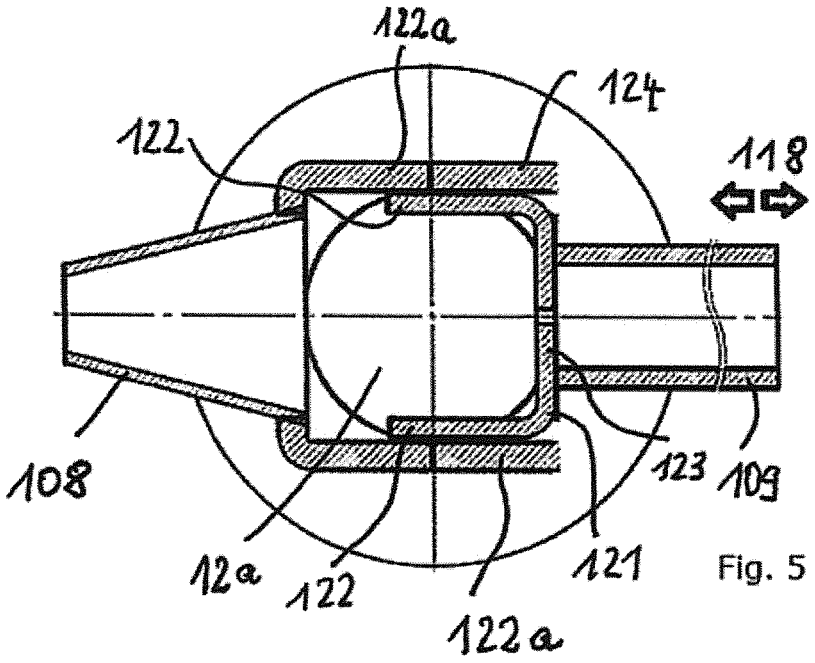
FIG. 5 is like FIG. 1, but as a horizontal section along the line A-B in FIG. 4.

The second embodiment of the duct of the fabric strand 12*a* depicted in the FIGS. 4 and 5, provides a pressure-sided joining 108 and a suction-sided joining 109 to the side channel blower 14 (FIG. 1). The compressed air is supplied in the direction of the arrow 100 through the pressure-sided joining 108, piped through the fabric strand 32 and removed in the direction of the arrow 100*a* through the suction-sided joining 109. The fabric strand 32 (FIG. 1) to be dehydrated is transported through the duct of the fabric strand 12*a* in the direction of the arrow 31 in a predetermined speed via the reel 4 and/or the transport nozzle 6 (FIG. 1).

The duct of the fabric strand 12*a* provides respectively a funnel-shaped extension 119*a* and 119*b* respectively on the inlet side and on the outlet side, by what the injection of the fabric strand to be dehydrated and the expel of the fabric strand are facilitated. Between those two funnel-shaped extensions a rectangular pipe-like middle section 120 extends. At opposite sections of the rectangular pipe-like middle section 120 the pressure-sided joining 108 and the suction-sided join 109 are provided. The air outlet of the pressure-sided joining is designed as a nozzle.

To the pressure-sided joining 108 a first U-shaped section 124 is attached in such a way, that it entwines a second U-shaped section 121, which is provided at the suctions-sided joining 109, partially by forming the rectangular pipe-like middle section 120, whereby the legs 122 of the second U-shaped section 121 fits hermetically to the legs 122*a* of the first U-shaped section 124. At the bottom of the second U-shaped section 121*a*, a pipe-like suction-sided joining 109 is provided. In this bottom section 123 opening heights are provided. To modify the cross section of the duct of the fabric strand 12*a* this suction-sided joining 109 is movable towards the pressure-sided joining 108 and also away from it, as it is marked with the double arrow 118. Accordingly, the cross section of the duct 12*a* of the fabric strand is reduced and enlarged in an adjustable measure. Thus, it is achieved that the duct of the fabric strand 12*a* is adaptable to the fabric strand 32 to be dehydrated respectively, by what the dehydration level and the careful transport of the fabric can be further optimized.

Figure 6:
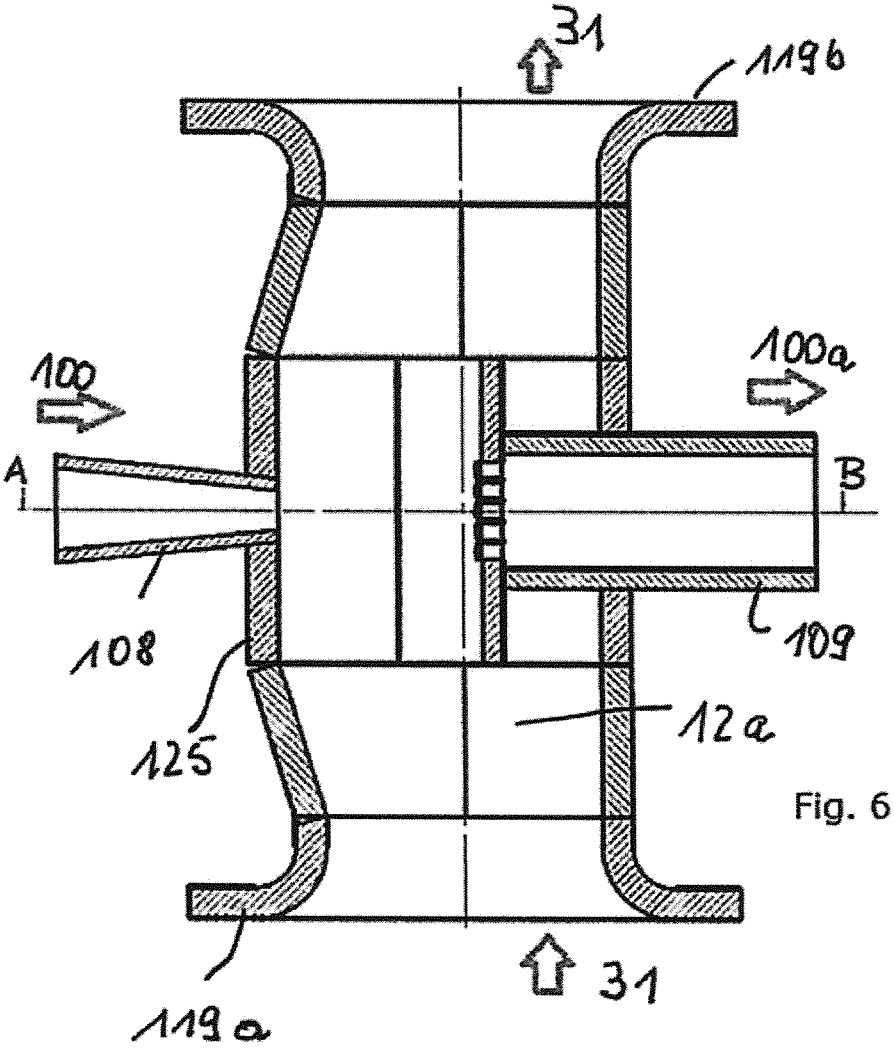
FIG. 6 is a schematic representation of a vertical section of a third embodiment of the duct of the fabric strand 12*a* of the dehydration module referred to as 12 in FIG. 1.
Figure 7:
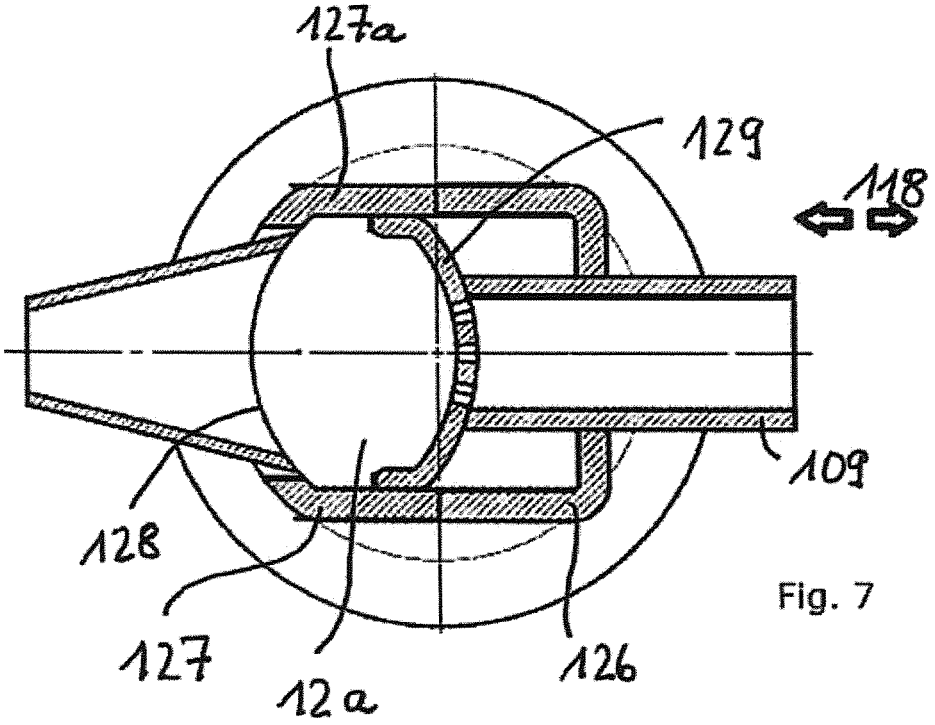
FIG. 7 is like FIG. 6, but as a horizontal section along the line A-B in FIG. 6.

The third embodiment of the dehydration module 12 depicted in the FIGS. 6 and 7 provides a duct of the fabric strand 12*a*, which contains a pressure-sided joining 108 and a suction-sided joining 109 to the side channel blower 14. The compressed air is supplied through the pressure-sided joining 108 in the direction of the arrow 100, piped through the duct of the fabric strand 32 and removed through the suction-sided joining 109 in the direction of the arrow 100*a*. The fabric strand to be dehydrated (not depicted) is transported through the duct of the fabric strand 12*a* in the direction of the arrow 31 via the reel 4 and/or the transport nozzle 6 in a predetermined speed. The duct of the fabric strand 12*a* provides respectively a funnel-shaped extension 119*a* and 119*b* respectively on the inlet side and on the outlet side, by what the injection of the fabric strand to be dehydrated 32 and the expel of the fabric strand are facilitated. Between those two funnel-shaped extensions 119 *a* and 119*b* a middle section 125 extends, which partially shows a U-shaped cross section 126, whereby the legs 127 and 127*a* of the U-shaped cross section 126 are attached to each other by a first, outwardly arched wall section 128, thereby forming the outer pipe in the middle section 125. Inside the outer pipe a second section 129 is arranged, which is arched oppositely to the first wall section and is mounted movable toward the first wall section 128 and away from it, as it is indicated by the double arrow 118.

The pressure-sided joining 108 to the side channel blower 14 is attached to the first, outwardly arched wall section 128 and the second suction-sided joining 109 to the side channel blower 14 is attached to the second arched section 129. In the second arched section opening heights are provided. This embodiment as well allows that the cross section of the duct of the fabric strand 12*a* can be reduced and enlarged to customize the duct of the fabric strand to the fabric to be dehydrated respectively. In this embodiment, also the pressure-sided joining is designed as a nozzle.

Figure 8:
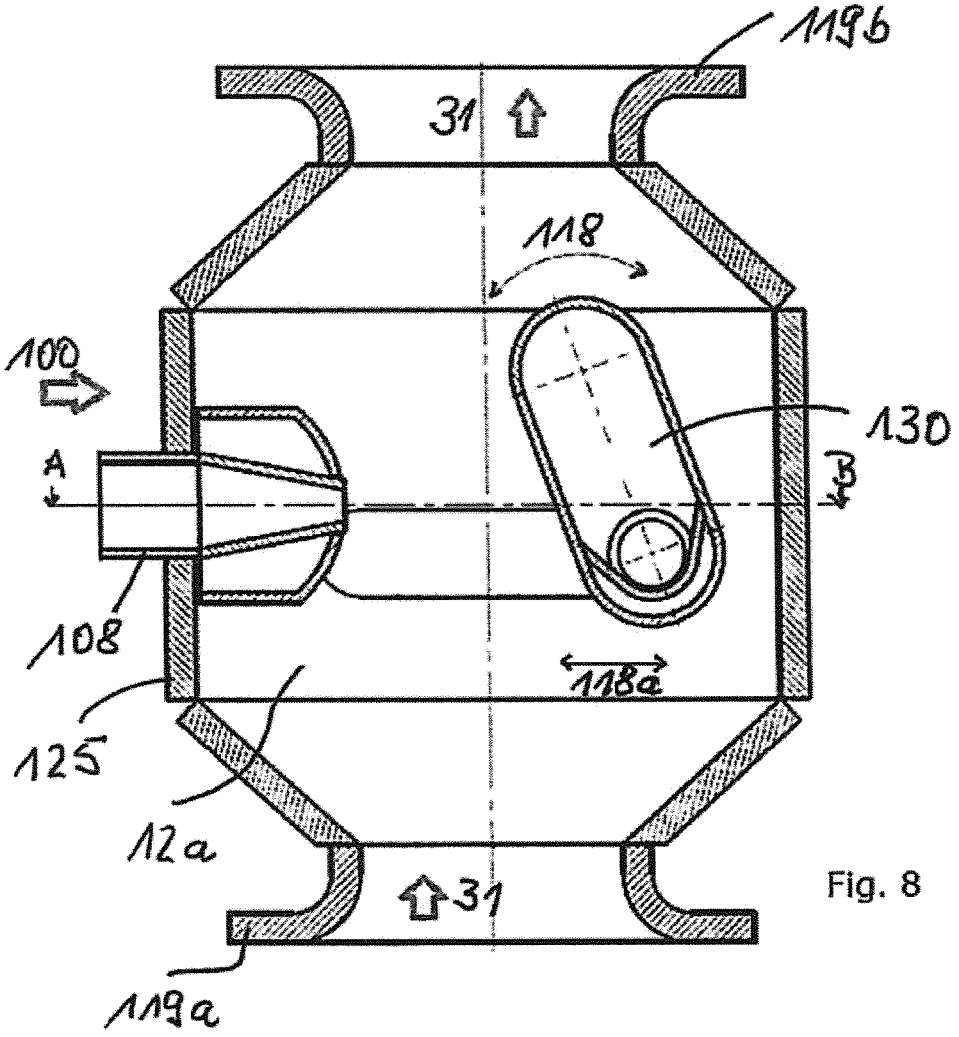
FIG. 8 is a schematic representation of a vertical section of a fourth embodiment of the duct of the fabric strand 12*a* of the dehydration module referred to as 12 in FIG. 1.
Figure 9:
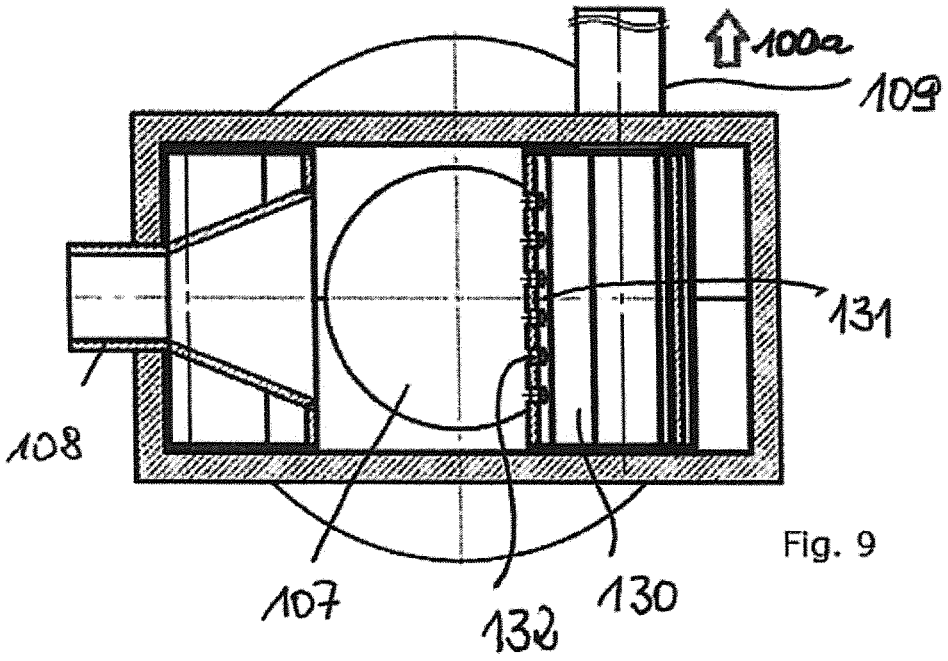
FIG. 9 is like FIG. 8, but as a horizontal section along the line A-B in FIG. 8.

The fourth embodiment of the duct of the fabric strand 12*a* of the dehydration module 12 shown in the FIGS. 8 and 9, also provides a pressure-sided joining 108 and a suction-sided joining 109 to the side channel blower 14 (FIG. 1). The compressed air is supplied in the direction of the arrow 100 through the pressure-sided joining, piped through the fabric strand 32 and removed in the direction of the arrow 110*a* (FIG. 9) through the suction-sided joining. The endless fabric strand 32 to be dehydrated is transported through the duct of the fabric strand 12*a* (FIG. 1) in the direction of the arrow 117 via the reel 4 and/or the transport nozzle 6 in a predetermined speed.

The duct of the fabric strand 12*a* provides respectively a funnel-shaped extension 119*a* and 119*b* respectively on the inlet side and on the outlet side, by what the injection of the fabric strand to be dehydrated and the expel of the fabric strand are facilitated. Between those two funnel-shaped extensions a middle section 125 extends. The pressure-sided joining 108 and the suction-sided joining 109 are attached to the opposite sections of the middle section 125. Also in this fourth embodiment, the air outlet of the pressure-sided joining 108 is designed as a nozzle.

The rectangularly shaped middle section 125 of the duct of the fabric strand 12*a* provides a suction chamber 130 at the opposite sections of the pressure-sided joining 108, which is swivel-mounted (swing mounted) in the direction of the arrow 130 and furthermore mounted shiftably hereto in the direction of the arrow 118*a*. Due to the swivel and shiftable mounting of the suction chamber 130 relatively to the pressure-sided joining 108 it is enabled, that the cross section of the duct of the fabric strand 12*a* is reduced or enlarged by swiveling of the suction chamber 130 in the direction of the arrow 118 and/or by shifting of the suction chamber 130 in the direction of the arrow 118*a* depending on the respective endless fabrics strand, whereby the swivel-mounted mounting of the suction chamber 130 additionally results in an optimizing of the mounting of the suction section for the air perfusing the endless fabric strand. The front surface 131 of the suction chamber 130 is provided with opening heights for air 132, so that the air sucked off at the suction-sided joining 109 gets into the suction chamber 130.

Depending on the width of the fabric strand, at least one application nozzle is provided in the treatment device 1 (shown in FIG. 10), although usually a number of application nozzles 24, which is adjusted to the width of the fabric strand, whereby the treatment bath volume sprayed on per time unit is sprayed on the fabric 32*a* by the application nozzle 24 respectively the number of transportation nozzles 24 during its transport.

As it is previously emphasized, the squeezing unit Q1 is not necessary inevitably or mandatorily, but is nevertheless purposefully allocated in the treatment device 1, whenever especially tight woven fabrics or comparatively thick fabrics, like especially terry goods, tarpaulin or woven fabrics for the production of sails or other, especially thick technical fabrics are treated. Also, this squeezing unit Q1 is advantageous if not the water volume, that is needed for adjusting the needed starting moisture of the fabric to be treated respectively via the application nozzle 24 in the beginning of the previously described method, is sprayed on the transported fabric per time unit, but a water volume bigger than the needed water volume, so that the needed exact starting moisture of the fabric can be configurated by means of the squeezing unit Q1.

Figure 10:
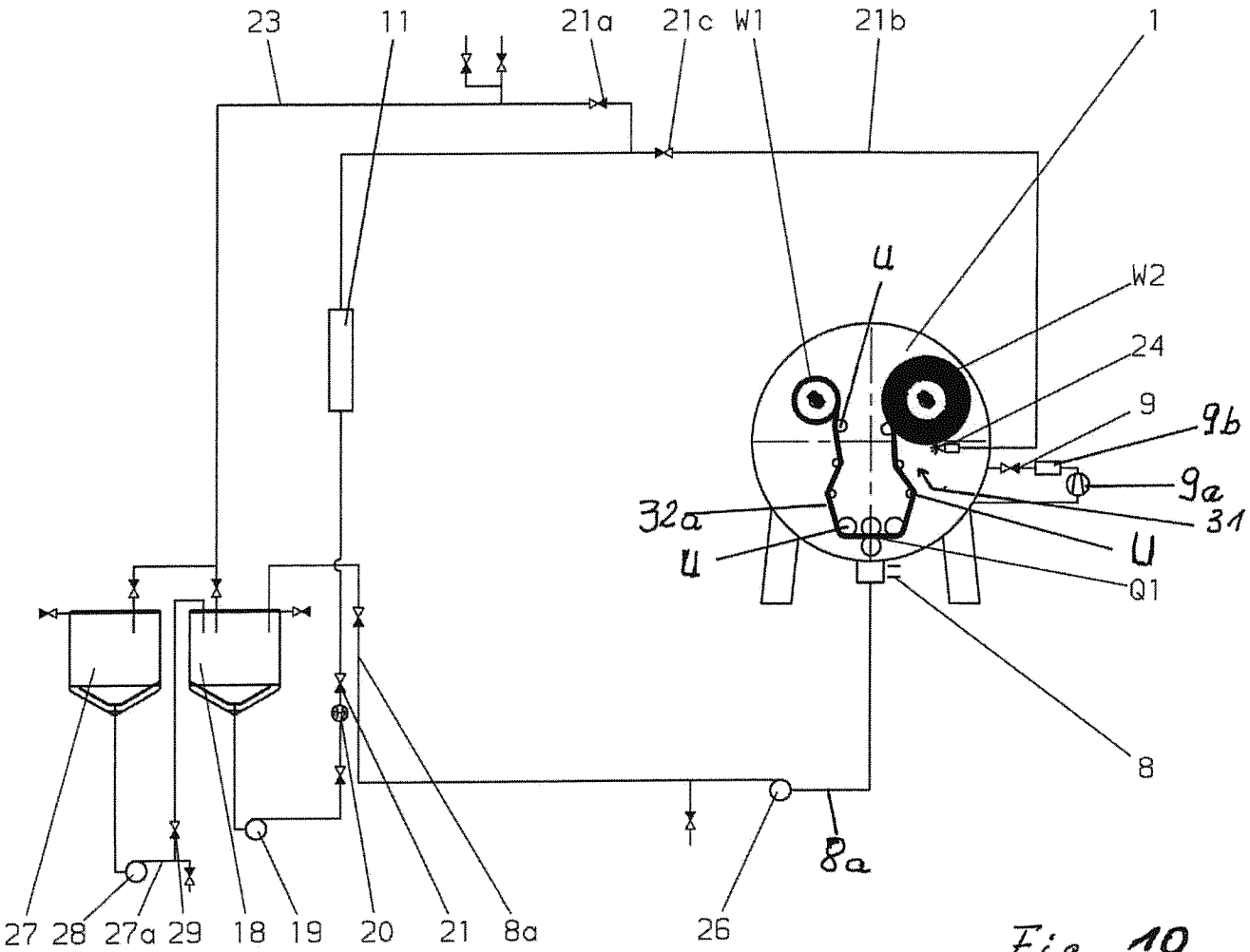
FIG. 10 is a second schematic figure of the device for the treatment of a fabric reel in a bride state, which is transported reversely in the treatment device.

Furthermore, a heating element overall referred to as 9 is attached to the treatment device 1 for heating the fabric to a predetermined treatment temperature, which includes an appropriate pipe 9*c*, a blower 9*a* and a heat exchanger 9*b* hereafter in the device shown in FIG. 10. Due to this heating element 9 the air is removed out of the treatment device through a pipe 9*a* by the blower 9*a* and fed into the treatment device 1 as heated air after passing the heat exchanger 9*b*.

As well as in the previously described first device, a collection vessel for the treatment bath 8 equipped with a level regulation is arranged at the foot side of the treatment device, so that bath which possibly drips off the fabric, is collected and piped to the vessel for treatment liquor 18 through the feedback pipe and thus this collected bath gets in contact again with the fabric during the treatment.

For determining the treatment bath volume configurated per time unit and sprayed on the fabric 32, which is reversely transported between the roll W1 and W2 via the application nozzle 24 respectively the number of application nozzles 24, which is respectively are preferably designed as a flat nozzle, a bypass is attached to the application nozzle 24 respectively the application nozzles 24, which includes a bypass calibration pipe 23, a pressure pump 19, a flowmeter 20, a first control valve 21, a second valve 21*a* and at least a vessel for treatment liquor 18.

As it is described previously in regards to the first device, the respective treatment bath is transported through the bypass calibration pipe 23 for so long through the pressure pump 19, the flowmeter 20, the first control valve 21, the heat exchanger 22 and the opened second valve 21*a*, until the treatment bath volume configurated per time unit is supplied reproducibly to the vessel for treatment liquor 18 through the bypass calibration pipe 23. Only then a third valve 21*c* is opened, through which the bypass calibration pipe 23 is attached to the application nozzle 24, while the second valve 21*a* is closed simultaneously, which leads to linear, progressive and/or degressive spraying of the treatment bath volume determined per time unit on the endless fabric web through the pipe 21*b* of the application nozzle 24, until the predetermined treatment time is elapsed or the treatment bath is sprayed on the textile substrate as far as possible. As far as possible in this context means, that despite a small dead volume of the treatment bath containing pipe almost the whole bath is sprayed on the textile substrate to be treated, whereby this pipe- and case-depending dead volume accounts for between about 2% to 6% referred to the total volume of the bath.

Furthermore, the device provides a vessel for preparing the treatment bath 27, which is attached to the vessel for treatment liquor 18 suchlike that treatment bath is injected from the vessel for preparing the treatment bath 27 to the vessel for treatment liquor 18 through the pipe 27*a* equipped with a further pressure pump 28 and a dispensing valve 29, preferably in a volume configurable per time unit.

Hereby it is enabled that the actual treatment bath can be split into two treatment baths for example, which contains different treatment agents or that the actual treatment bath contains a number of treatment agents and thus is split into a first treatment bath proportion, which is allocated in the vessel for treatment liquor 18, and a second treatment bath proportion, whereby the second treatment bath proportion is allocated in the vessel for preparing the treatment bath 27, so that a controlled, time-delayed exposure of equal and different treatment agents is allowed due to time-delayed addition of the first treatment bath and the second treatment bath.

Figure 11:
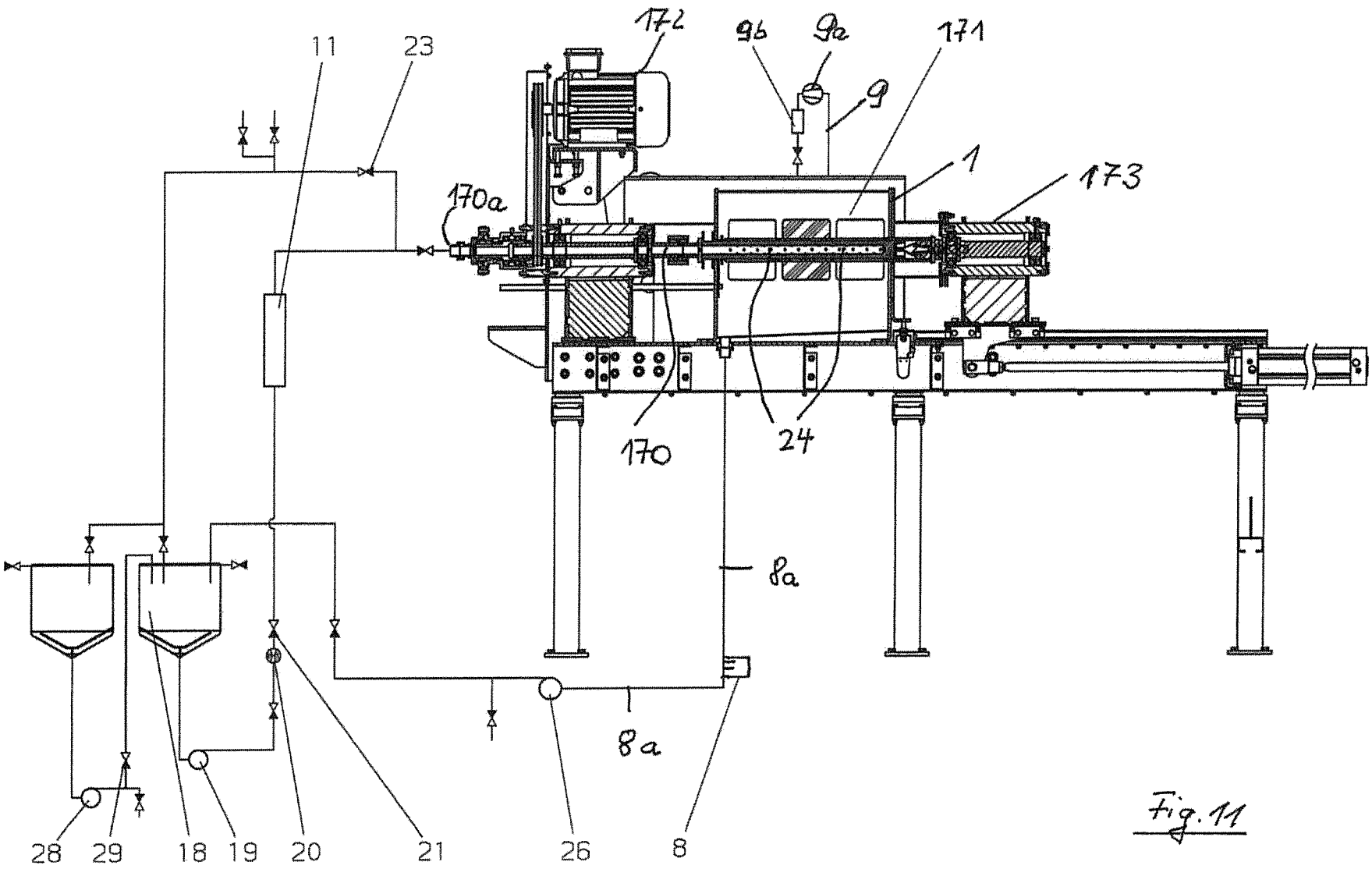
FIG. 11 is a schematic figure of the third device for the treatment of a textile substrate designed as a fabric reel, in which the sprayed treatment bath is transported by rotation of the fabric reel.

The third device for realization the previously described method depicted in FIG. 11 provides a treatment device 1 which is equipped with a central, horizontal centrifuge shaft 170 for mounting the textile substrate to be treated 171 during the treatment. Thereby the textile substrate respectively treated with the treatment bath is designed as a thread package, meaning thus as a thread bobbin 171 or as a fabric web wound up on a fabric beam (breast beam). The centrifuge shaft 170 provides a horizontal central bore 170*a*, whereby this horizontal central bore 170*a* is equipped with at least one bath opening height and preferably with a number of bath opening heights, whereby those baths opening height meaning bath opening heights are designed as an application nozzle 24 or as a number of application nozzles 24. Furthermore, the centrifuge shaft 170 is equipped with a rotational drive 172 at its one end which is configurable according to its rotational speed, and with a bearing block 173 at its other end, whereby the rotational drive 172 as well as the bearing block 173 are placed outside the treatment device 1.

The charging of the treatment liquor to the central bore 170*a* provided in the centrifuge shaft 170 occurs at the position which is labelled with the reference sign 170*a* in FIG. 11. To the treatment device 1 a low-volume collection vessel for the treatment bath 8 is attached at the bottom side, whereby this collection vessel for the treatment bath 8 provides a level regulation 8*a* in a way, that in case of exceeding a predetermined level, the bath which is not absorbed by the textile substrate and spun off, is collected in the collection vessel for the treatment bath and can be returned through a feedback pipe 8*a*.

Furthermore, a heating element overall referred to as 9 for heating of the fabric reel to a predetermined treatment temperature is provides to the treatment device 1, which consists of an appropriate pipe 9*c*, a blower 9*a* and a following heat exchanger 9*b* in the device depicted in FIG. 11. Through this heat exchanger 9*b* air is removed from the treatment device 1 by the blower 9*a* through a pipe 9*c* and injected in the treatment device 1 after as heated air after passing the heat exchanger 9*b*.

To feed the treatment device with the textile subject to be treated (thread bobbin, fabric reel) and to remove this textile substrate after the treatment, the treatment device is constructed bipartitely and provides a removable part, which is attached to the bearing block 173, whereby the treatment centrifuge, which is only depicted schematically in FIG. 11, is described in detail in DE 10 2015 012 544.3, so that the disclosure of DE 10 2015 012 544.3 is made as the content of this description to prevent repetition.

To determine the treatment bath volume configurable per time unit and to spray it on the fabric reel 171, that rotates in a configurable rotational speed via the application nozzle 24 respectively the number of application nozzles 24, which is respectively are preferably designed as a flat nozzle, a bypass is attached to the application nozzle respectively the application nozzles, which includes a bypass calibration pipe 23, a pressure pump 19, a flowmeter 20, a first control valve 21, a second valve 21*a* and at least one vessel for treatment liquor 18.

As it is already described previously for the first and the second device, the respective treatment bath is transported through the bypass calibration pipe 23, the pressure pump 19, the flowmeter 20, the first control valve 21, the heat exchanger 22 and the opened second valve 21*a* as long as the treatment bath volume configurated per time unit is supplied reproducibly to the collection vessel for the treatment bath 18 through the bypass calibration pipe 23. Just then a third valve 21*c*, due to which the bypass calibration pipe 23 is attached to the application nozzle 24 through the central bore 170*a* provided in the centrifuge shaft 170, is opened, while the second valve is closed simultaneously to this, which leads to linear, progressive and/or degressive spraying of the treatment bath volume determined per time unit on the fabric reel through the pipe 21*b* by the central bore 170*a* and thus the application nozzle 24, until the predetermined treatment time is elapsed or the treatment bath is sprayed on the textile substrate as far as possible.

The configuration of the moisture determined in the beginning of the treatment (according to the characteristic a) of the main claim) happens analogously, whereby the treatment bath therefore described in the previous paragraph is replaced by water, so that an appropriate water bath volume is applied reproducible instead of the treatment bath volume.

Furthermore, the device provides a vessel for preparing the treatment bath 27, which is attached to the vessel for treatment liquor 18 through a pipe 27*a* suchlike, that the treatment bath is injected from the vessel for preparing the treatment bath to the vessel for treatment liquor through the pipe 27*a*, which is equipped with a further pressure pump 28 and a dispensing valve 29, preferably with a volume configurated per time unit.

Thus enables that the actual treatment bath can be split in two treatment baths, that contain different treatment agents, or that the actual treatment bath contains a number of treatment agents and thus is split into a first treatment bath proportion, which is allocated in the vessel for treatment liquor 18, and a second treatment bath proportion, whereby the second treatment bath proportion is allocated in the vessel for preparing the treatment bath 27, so that a controlled, time-delayed exposure of equal and different treatment agents is allowed due to time-delayed addition of the first treatment bath and the second treatment bath.

Examples

As dyeing allows an especially critical and easy assessment of the dyed textile substrate, especially according to the aspects different shades of color, reproducibility, equality, color differences to the length and width of the dyed fabric and color fastness, and to eliminate the impacts of the pre-treatment and the rewashing, especially the impact of the soaping during reactive dyeing, the three textile substrates listed hereafter in Table 1 were conventionally boiled and bleached and conventionally washed and soaped after the dyeing. After that three textile substrates were dyed respectively in a light shade (yellow, substrate 3) and in a dark shade (black, substrate 1 and 2) in the treatment device depicted and described in FIG. 1 using the previously described method.

All three textile substrates were made of cotton and were present as single jersey or as piqué and as tubular fabric. The following Table 1 summarizes the relevant data of the dyed textile substrates. The dyeing was implemented at a temperature of 60° C.

TABLE 1

| Substrate | Weight (dry) [kg] | Strand length [m] | Time per revolution [min] | Treatment bath volume sprayed on [l/min] |
|---|---|---|---|---|
| 1, piqué | 198 | 813 | 1.85 | 3.1 |
| 2, piqué | 79.5 | 327 | 1.42 | 2.9 |
| 3, single jersey | 81 | 498 | 1.65 | 2.9 |

The single jersey, substrate 3, was dyed yellowy by using the dye combination 1, whereas the other two piqué-products, substrate 1 and 2, were dyed in color black by using the dye combination 2. The reactive dye used therefore and their concentration, referred to the respective fabric weight, are summarized in Table 2.

TABLE 2

| Dye combination | Dye | Dye concentration referred to the respective fabric weight |
|---|---|---|
| 1 | Levafix Brillant Yellow CA, | 1.0150% |
| | Levafix Yellow CA, | 0.3190% |
| | Levafix Fast Red CA | 0.0052% |
| 2 | Remazol Gold Gelb RGB | 0.9450% |
| | Remazol Ultra Carmine RGB | 0.5376% |
| | Remazol Deep Black GWF | 6.5600% |

The previously mentioned Levafix-dyes were present as granulate.

In the beginning of the dyeing the fabric to be respectively dyed was pulled in in the treatment device depicted in FIG. 1 and was made into an endless fabrics strand by the previously described method. Due to spraying a predefined amount of water on the endless fabric strand, which was transported by the transport nozzle 6 in the speed stated in Table 1, by the application nozzle 24, a starting moisture of 140% was configurated for the single jersey and a starting moisture of 150% was configurated for the piqué, respectively referred to the dry fabric weight.

Due to following spraying of the aqueous dye bath, a soda bath containing 15 g/l and a bath containing 4.5 ml/l sodium hydroxide (concentration of the sodium hydroxide: 38° Bè) one after the other via the application nozzle 24, the respective dyeing was implemented. The three previously mentioned bathes were applied reproducibly by the application nozzle 24 with the bath volume which is exactly and reproducibly adjusted by the bypass according to Table 1.

The following Table 3 concretizes the previously stated information.

TABLE 3

| Substrate | Starting moisture immediately bevor dyeing | End moisture immediately after dyeing | Volume of the dyeing bath [litre] | Volume of the soda bath [litre] | Volume of sodium natrium hydroxide bath [litre] |
|---|---|---|---|---|---|
| 1, piqué | 150% | 215% | 60 | 25 | 45 |
| 2, piqué | 150% | 218% | 22 | 14 | 18 |
| 3, single jersey | 140% | 196% | 25 | 20 | 0 |

In the beginning of the dyeing and after a previous adjusting of the previously stated starting moisture and the exact and reproducible adjusting of the bath sprayed through the application nozzle 24 the dyeing bath, which was respectively half split into the cases 18 and 27, was sprayed linearly on the transported fabric strand 32 with the value stated in Table 1 at a temperature of 50° C. After the split amount of bath located in case 18 was almost depleted after 6 to 8 minutes, the dyeing bath from the case 27 was dosed also linearly in the case 18. As soon as a certain bath level was reached in case 27, the previously stated soda bath and after that the sodium hydroxide bath stated in Table 3 was supplied for fixing the dye in the case 27 and dosed from here in case 18, so that these baths were also sprayed on in a volume reducibly adjusted per time unit via the application nozzle 24. After finishing this fixing process, the dyed fabric was neutralized by the addition of acetic acid and post-treated accordingly to a conventional method by rinsing and/or soaping as it is described and justified previously.

The dyed textile substrates 1 to 3 were dyed impeccably equal, did neither show different colors relative to the length or to the width, just as little than color stains or inequalities, but they did show the excellent fastnesses which are praised by the producer of the dyes stated in Table 2.

The determination of the moisture of the textile substrate in the beginning of the treatment occurs in accordance to DIN 53923. Here the dry weight of the dry textile substrate to be respectively treated is determined with multiple punched samples. After wetting the textile substrate with water in the beginning of the claimed method and after the respective treatment is made after application of the treatment bath volume adjusted exactly per time unit, the respective punched "starting sample" and "end sample" were removed and weighted again after two minutes of free-hanging draining.

What is claimed is:

1. A method for treatment of a textile substrate, at which the textile substrate is arranged in a treatment device and there treated with an aqueous treatment bath, that contains chemicals and treatment agents needed for the respective treatment in a concentration chosen for the respective treatment, comprising the steps of:

a) adjusting in the beginning of the treatment, the moisture of the textile substrate to be treated to 40% to 180%, relative to the dry weight of the textile substrate to be treated, b) heating the textile substrate to a temperature needed for the respective treatment previously, simultaneously herewith or hereafter, c) determining a treatment bath volume adjusted per time unit by pumping the treatment bath via a bypass calibration pipe from at least one vessel for preparing the treatment bath through a pressure pump, a flowmeter and a control valve back into the at least one vessel for preparing the treatment bath, wherein the treatment bath is transported through the bypass calibration pipe as long as the treatment bath volume calibrated per time is supplied reproducibly to the vessel, d) spraying hereafter the treatment bath volume of the respective treatment determined per time unit linearly, progressively and/or degressively on the textile substrate for a predetermined treatment time, so that due to the spraying of the treatment bath volume during the treatment the moisture of the textile substrate is linearly, progressively and/or degressively increased thus far, that the treated textile substrate has final moisture values between 70% and 300%, at the end of the treatment, relative to the dry weight of the textile substrate to be treated, e) transporting during the spraying of the treatment bath on the textile substrate, the textile substrate in the treatment device with an even speed as an endless fabric strand, or reversibly as a fabric web package in a width state, or, if the textile substrate is designed as a fabric reel, the sprayed treatment bath is transported through the textile substrate by rotation of the fabric reel, and f) removing the treatment bath which is isolated and not absorbed during treatment from the textile substrate, collecting and spraying again until the predetermined treatment time is elapsed or the treatment bath is sprayed on the textile substrate as far as possible.

2. The method according to claim 1, wherein the textile substrate is designed as an endless fabric strand or as reversibly transported fabric web package, that the moisture of the textile substrate to be treated is adjusted by spraying a defined water volume on the textile substrate in the beginning of the treatment and that the endless fabric strand or the fabric web package is transported in the treatment device for a predetermined time until the textile substrate provides the moisture needed in the beginning of the treatment of between 40% and 180%, relative to the dry weight of the textile substrate to be treated, viewed over the entire surface.

3. The method according to claim 1, wherein the textile substrate is designed as the fabric reel, and the moisture of the textile substrate to be treated is adjusted by spraying a defined water volume on the textile substrate in the beginning of the treatment, and that the fabric reel is rotated, until the textile substrate provides a moisture between 40% and 180%, relative to the dry weight of the textile substrate to be treated.

4. The method according to the claim 1, wherein the textile substrate is designed as an endless fabric strand or as a fabric web package, and the textile substrate is wetted with water in the beginning of the treatment, and that hereafter a dehydration of the wetted textile substrate to the moisture adjusted in the beginning of the treatment is carried out.

5. The method according to claim 4, wherein the dehydration of the textile substrate is carried out by flow against and/or by perfusing with air.

6. The method according to claim 1, wherein the temperature of the textile substrate to be treated is adjusted to a value between 40° C. and 140° C., depending on the respective kind of treatment and the fiber substrate to be treated.

7. The method according to claim 6, wherein the textile substrate to be treated consists of synthetic fibers.

8. The method according to claim 1, wherein the textile substrate to be treated consists of natural fibers and that the treatment is carried out of a temperature of the textile substrate to be treated between 40° C. and 110° C.

9. The method according to claim 1, wherein the textile substrate to be treated consists of natural fibers or contains them predominantly and that the moisture of the textile substrate to be treated is adjusted to 80% to 180% in the beginning of the treatment, respectively relative to the dry weight of the textile substrate to be treated.

10. The method according to claim 9, wherein the textile substrate to be treated consists of natural fibers or contains them predominantly and that the moisture of the textile substrate is increased during treatment by spraying of the treatment bath, until the textile substrate provides a final moisture value between 180% and 300%, at the end of the treatment, respectively relative to the dry weight of the textile substrate to be treated.

11. The method according to claim 1, wherein the textile substrate to be treated consists of synthetic fibers or contains them predominantly and that the moisture of the textile substrate to be treated is adjusted to 40% to 120%, in the beginning of the treatment, respectively relative to the dry weight of the textile substrate.

12. The method according to claim 11, wherein the moisture of the textile substrate is increased during treatment by spraying of the treatment bath, until the textile substrate provides a final moisture value between 90% and 250%, at the end of the treatment, respectively relative to the dry weight of the textile substrate to be treated.

13. The method according to claim 1, wherein the treatment bath volume sprayed on per time unit is varied between 1 l/min and 12 l/min.

14. The method according to claim 13, wherein the treatment bath to be sprayed on is sprayed on the textile substrate to be treated with a pressure between 1.5 bar and 6 bar.

15. The method according to claim 1, wherein the textile substrate is heated to the respectively needed treatment temperature by tempered air appropriately supplied into the treatment device, which particularly also causes the transport of an endless fabric strand during its treatment, and/or by radiant heat during the whole treatment.

16. The method according to claim 1, wherein a pretreatment bath, a bleaching bath, an alkalization bath, a desizing bath, an enzyme bath, a dyeing bath, a washing bath, a soaping bath, a post-treatment bath and/or a softening bath is chosen as treatment bath.

17. The method according to claim 1, wherein the fabric reel is driven with a rate of rotation between 700 rpm and 4,000 rpm during the adjustment of the moisture in the beginning of the treatment and with a rate of rotation between 5 rpm and 1,200 rpm after the spraying of the treatment bath volume determined per time unit.

18. The method according to claim 1, wherein a substrate consisting of cotton or a cotton-containing substrate is treated and especially dyed as textile substrate with a dyeing bath containing at least one reactive dye.

19. The method according to claim 18, wherein the amount of salt used in the dyeing process is reduced, whereby the concentration of the reduced amount of salt varies between 0 g/l and 30 g/l.

20. The method according to claim 4, wherein the water is heated water or saturated steam.

21. The method according to claim 5, wherein the air is heated air.

22. The method according to claim 9, wherein the moisture of the textile substrate to be treated is adjusted to 120% to 180%.

* * * * *